US008906814B2

(12) United States Patent
Lee et al.

(10) Patent No.: US 8,906,814 B2
(45) Date of Patent: Dec. 9, 2014

(54) HIGHLY REACTIVE MULTILAYER ASSEMBLED COATING OF METAL OXIDES ON ORGANIC AND INORGANIC SUBSTRATES

(75) Inventors: Jung Ah Lee, Malden, MA (US); Randall M. Hill, Cambridge, MA (US); Paula T. Hammond, Newton, MA (US); Gregory C. Rutledge, Newton, MA (US); Kevin C. Krogman, Santa Clara, CA (US)

(73) Assignee: Massachusetts Institute of Technology, Cambridge, MA (US)

( * ) Notice: Subject to any disclaimer, the term of this patent is extended or adjusted under 35 U.S.C. 154(b) by 1416 days.

(21) Appl. No.: 12/542,174

(22) Filed: Aug. 17, 2009

(65) Prior Publication Data

US 2010/0130082 A1 May 27, 2010

Related U.S. Application Data

(60) Provisional application No. 61/089,717, filed on Aug. 18, 2008.

(51) Int. Cl.

| | |
|---|---|
| ***D06M 11/36*** | (2006.01) |
| ***D06M 11/45*** | (2006.01) |
| ***D06M 11/46*** | (2006.01) |
| ***D06M 11/78*** | (2006.01) |

(52) U.S. Cl.

CPC ..... *D06M 11/36* (2013.01); *D06M 11/45* (2013.01); *D06M 11/46* (2013.01); *D06M 11/78* (2013.01); *D06M 2200/25* (2013.01)

USPC ..... 442/181; 428/221; 428/380; 428/323; 428/447; 428/702; 442/417

(58) Field of Classification Search

USPC ..... 442/181, 417

See application file for complete search history.

(56) References Cited

U.S. PATENT DOCUMENTS

| | | | | |
|---|---|---|---|---|
| 5,789,071 | A | 8/1998 | Sproul et al. | |
| 2004/0120915 | A1 * | 6/2004 | Yang et al. | 424/70.13 |
| 2005/0192364 | A1 * | 9/2005 | Lichtenhan et al. | 521/50 |
| 2006/0292369 | A1 * | 12/2006 | Rutledge et al. | 428/364 |
| 2008/0038458 | A1 * | 2/2008 | Gemici et al. | 427/180 |
| 2008/0050641 | A1 | 2/2008 | Dressick | |
| 2008/0051281 | A1 | 2/2008 | Dressick | |

FOREIGN PATENT DOCUMENTS

| | | | |
|---|---|---|---|
| WO | WO-01/78906 | A1 | 10/2001 |
| WO | WO-2008/069848 | A2 | 6/2008 |

OTHER PUBLICATIONS

Ladhari, N. et al., "Stratified PEI-(PSS-PDADMAC)$_{20}$-PSS-(PDADMAC-$TiO_2$)$_n$ multilayer films produced by spray deposition," Colloids and Surfaces A: Physiochemical and Engineering Aspects, Mar. 2008, vol. 322, pp. 142-147.

Lee, J.A. et al., "Highly Reactive Multilayer-Assembled TiO2 Coating on Electrospun Polymer Nanofibers," Advanced Materials 21, 1252-1256 (2009).

(Continued)

*Primary Examiner* — Peter Y Choi

*Assistant Examiner* — Vincent A Tatesure

(74) *Attorney, Agent, or Firm* — Dana M. Gordon; Foley Hoag LLP

(57) ABSTRACT

One aspect of the invention relates to a method of preparing metal oxide coated substrates for various potential applications, and the coated substrate formed thereby.

19 Claims, 12 Drawing Sheets

(56) References Cited

OTHER PUBLICATIONS

Krogman, K.C. et al., "Spraying Asymmetry into Functional Membranes Layer-by-Layer," Nature Materials 8, 512-518 (2009).
Krogman, K.C. et al.,"Photocatalytic Layer-by-Layer Coatings for Degradation of Acutely Toxic Agents," Chem. Mater. 20: 1924-1930 (2008).
Tuteja, A. et al., "Designing Superoleophobic Surfaces," Science 318: 1618-1622 (2007).
Ma, M. et al., "Decorated Electrospun Fibers Exhibiting Superhydrophobicity" Advance Materials 19: 255-259 (2007).
Sugimoto, T. et al., "Synthesis of Uniform Anatase $TiO_2$ Nanoparticles by Gel-Sol Method. 3. Formation Process and Size Control," Journal of Colloid and Interface Science 259: 43-52 (2003).
Sugimoto, T. et al., "Synthesis of Uniform Anatase $TiO_2$ Nanoparticles by Gel-Sol Method. 4. Shape Control," Journal of Colloid and Interface Science 259: 53-61 (2003).
Ding, B. et al., "Layer-by-Layer Structured Films of $TiO_2$ Nanoparticles and Poly(acrylic acid) on elctrospun nanofibers," Nanotechnology 15: 913-917 (2004).
Drew, C. et al., "Metal Oxide-Coated Polymer Nanofibers," Nano Letters 3(2): 143-147 (2003).
Li, D. et al., "Fabrication of Titania Nanofibers by Electrospinning," Nano Letters 3(4): 555-560 (2003).
International Search Report for PCT/US2009/053998 mailed Jan. 21, 2010.

* cited by examiner

| Polymer | Solvent | Concentration [wt%] | Voltage [kV] | Plate-to-plate distance [cm] | Flow rate [mL/min] |
|---|---|---|---|---|---|
| PS | N,N-dimethylacetamide (DMA) | 22 | 30 | 35 | 0.01 |
| PAN | N,N-dimethylformamide (DMF) | 10 | 28 | 30 | 0.015 |
| PMMA/PEO | N,N-dimethylacetamide (DMF) | 5/0.5 | 20 | 45 | 0.02 |

POSS Cage Molecule

Monfunctional POSS Molecule

Multifunctional POSS Molecule

R = trifluoropropyl

R = *i*-butyl

**R = *1H,1H,2H,2H*-heptadecafluorodecyl**

**R = *1H,1H,2H,2H*-tridecafluorooctyl**

HIGHLY REACTIVE MULTILAYER ASSEMBLED COATING OF METAL OXIDES ON ORGANIC AND INORGANIC SUBSTRATES

RELATED APPLICATION

This application claims the benefit of priority to U.S. Provisional Patent Application Ser. No. 61/089,717, filed Aug. 18, 2008; the content of which is hereby incorporated by reference.

GOVERNMENT SUPPORT

This invention was made with government support under grant number W911NF-07-D-0004 awarded by the Army. The government has certain rights in this invention.

BACKGROUND

Growing concerns over the threat of chemical warfare agents and exposure to toxic industrial chemicals (TIC) have drawn much attention to the challenge of developing new methods for protection against and decomposition of toxic organic materials. Photocatalytic degradation using titanium dioxide ($TiO_2$) is one of the most widely studied methods because it efficiently converts abundant solar energy into effective chemical energy that can be applied to decompose harmful organic materials in air and water. A. Fujishima, K. Honda, *Nature* 1972, 238, 37; M. Fujihira, Y. Satoh, T. Osa, *Nature* 1981, 293, 206; P. Sawunyama, A. Fujishima, K. Hashimoto, *Langmuir* 1999, 15, 3551; K. Nagaveni, G. Sivalingam, M. S. Hegde, G. Madras, *Environ. Sci. Technol.* 2004, 38, 1600. UV illumination of $TiO_2$ excites electrons from the valence band to the conduction band, leaving holes in the valence band. The electrons then react with oxygen to produce superoxide anions, and the holes react with water to produce hydroxyl radicals. These two species are very reactive and able to decompose a variety of organic toxic chemicals. A. Fujishima, K. Honda, *Nature* 1972, 238, 37.

However, the photocatalytic degradation of toxic chemicals, including chemical warfare agents, using $TiO_2$ is still challenging in terms of high reaction efficiency with natural sunlight (or mild UV light), immobilization on the supporting materials, and sufficient activity without degradation of the supporting materials. For best photocatalytic activity, a high surface area, anatase crystalline structure of $TiO_2$ is required. Therefore, many researchers have focused on decreasing the particle size and increasing the surface-to-volume ratio of $TiO_2$ to enhance its photocatalytic activity. M. Anpo, T. Shima, S. Kodama, Y. Kubokawa, *J. Phys. Chem.* 1987, 91, 4305; and S. Y. Chae, M. K. Park, S. K. Lee, T. Y. Kim, S. K. Kim, W. I. Lee, *Chem. Mater.* 2003, 15, 3326. Fibrous structures of $TiO_2$ have been made by electrospinning of $TiO_2$ precursors from mixed solutions, but there are few reports of depositing well-characterized anatase $TiO_2$ nanoparticles directly onto submicron fibers at room temperature as a post treatment. T. Sugimoto, X. P. Zhou, A. Muramatsu, *J. Colloid Interface Sci.* 2003, 259, 43; C. Drew, X. Liu, D. Ziegler, X. Y. Wang, F. F. Bruno, J. Whitten, L. A. Samuelson, J. Kumar, *Nano Lett.* 2003, 3, 143; and D. Li, Y. N. Xia, *Nano Lett.* 2003, 3, 555. Furthermore, $TiO_2$ fibers prepared using electrospinning from a precursor solution such as titanium alkoxides ($Ti(OR)_4$) with poly(vinyl pyrrolidone) are quite brittle due to their polycrystalline nature, and do not appear to be suitable for photocatalytic applications until after calcination. As a subsequent step, this calcination leads to the formation of anatase $TiO_2$ polycrystalline nanofibers. D. Li, Y. N. Xia, *Nano Lett.* 2003, 3, 555; and Y. L. Hong, D. M. Li, J. Zheng, G. T. Zou, *Nanotechnology* 2006, 17, 1986. The brittleness can be overcome by depositing $TiO_2$ on polymeric nanofibers, but it remains a critical challenge to fabricate polymeric nanofibers having high photocatalytic activity without the degradation of polymeric substrates.

SUMMARY

One aspect of the invention relates to a method of preparing metal oxide-coated substrates for various potential applications, such as a protective clothing system, woven fabric, a non-woven fabric, a filter, an adsorbant, photocatalysis, sensors, and electrodes. In certain embodiments, the coatings described herein comprise a plurality of alternating layers of negatively charged metal oxide nanoparticles and suitable cationic molecules. For example, it is disclosed herein that negatively charged colloidal titania nanoparticles can be adsorbed directly onto electrospun polymer fibers in the form of an ultrathin conformal coating by utilizing Layer-by-Layer (LbL) deposition with positively-charged polyhedral oligomeric silsesquioxane (POSS) molecules. In another embodiment, the coatings described herein comprise a plurality of alternating layers of positively charged metal oxide nanoparticles and suitable anionic molecules. For example, positively charged colloidal titania nanoparticles and negatively-charged polyhedral oligomeric silsesquioxane (POSS) molecules could be used to form a LbL coating.

In certain embodiments, by choosing appropriate materials, coated polymer nanofibers can be protected against degradation by photocatalysis. For example, in the case of the positively charged POSS molecules mentioned above, when used as the cation for titania coating, it is believed the POSS molecules enhance the stability of the original substrates against thermal, chemical, and UV degradation.

In addition, for certain embodiments comprising titania nanoparticles, it is proposed that the combination of such nanoparticles and nanoscale electrospun fibers will lead to a remarkable increase in the number of reactive sites with a corresponding improvement in the photocatalytic activity of the titania.

and without (b) UV illumination for 2 h. The detection limit is 0.01 ppm and some data points of (a) were below the detection limit.

Figure 6:
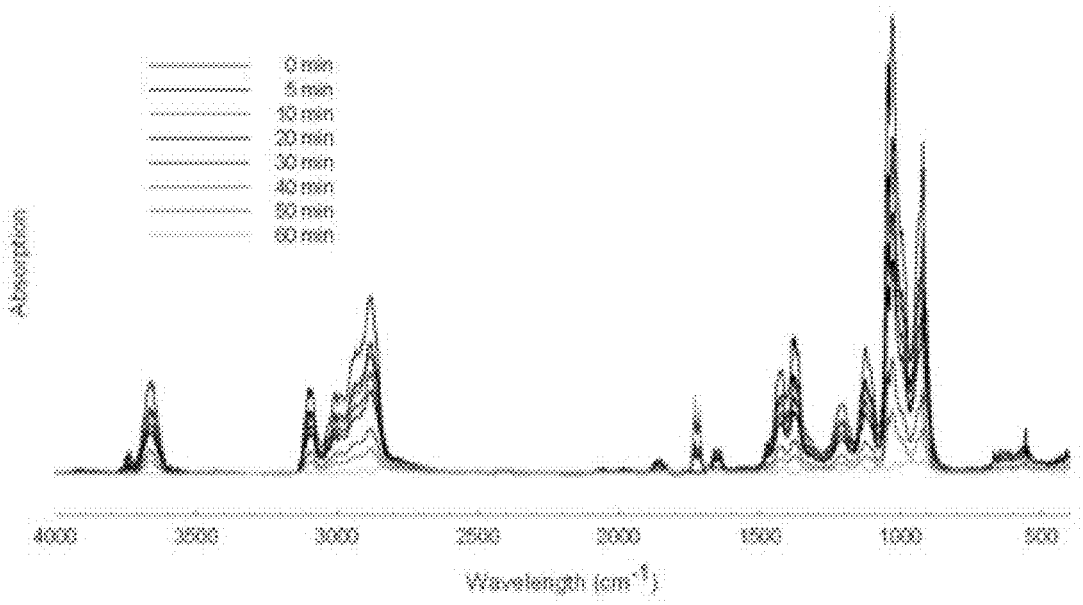

FIG. 6 depicts FTIR spectra of allyl alcohol collected during a closed quartz cell batch analysis with a $TiO_2$-coated electrospun mat.

Figure 4:
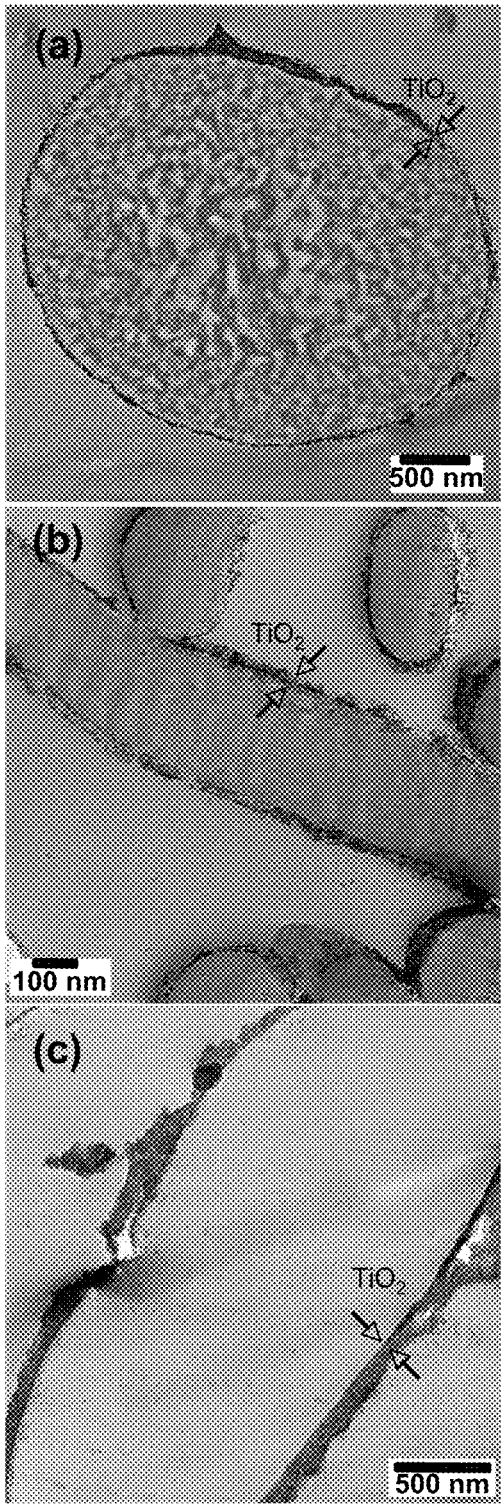
FIG. 4 depicts TEM images of $TiO_2$-coated electrospun fibers: (a) polystyrene, (b) polyacrylonitrile, and (c) poly (methyl methacrylate)/poly(ethylene oxide) blend.
Figure 7:
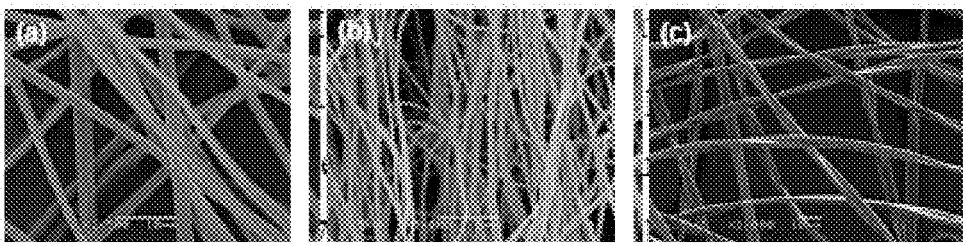

FIG. 7 depicts the electrospinning parameters for different polymers in FIG. 4, as well as SEM images of the electrospun fibers: (a) polystyrene (PS), (b) polyacrylonitrile (PAN), and (c) poly(methyl methacrylate)/poly(ethylene oxide) (PMMA/PEO).

Figure 8:
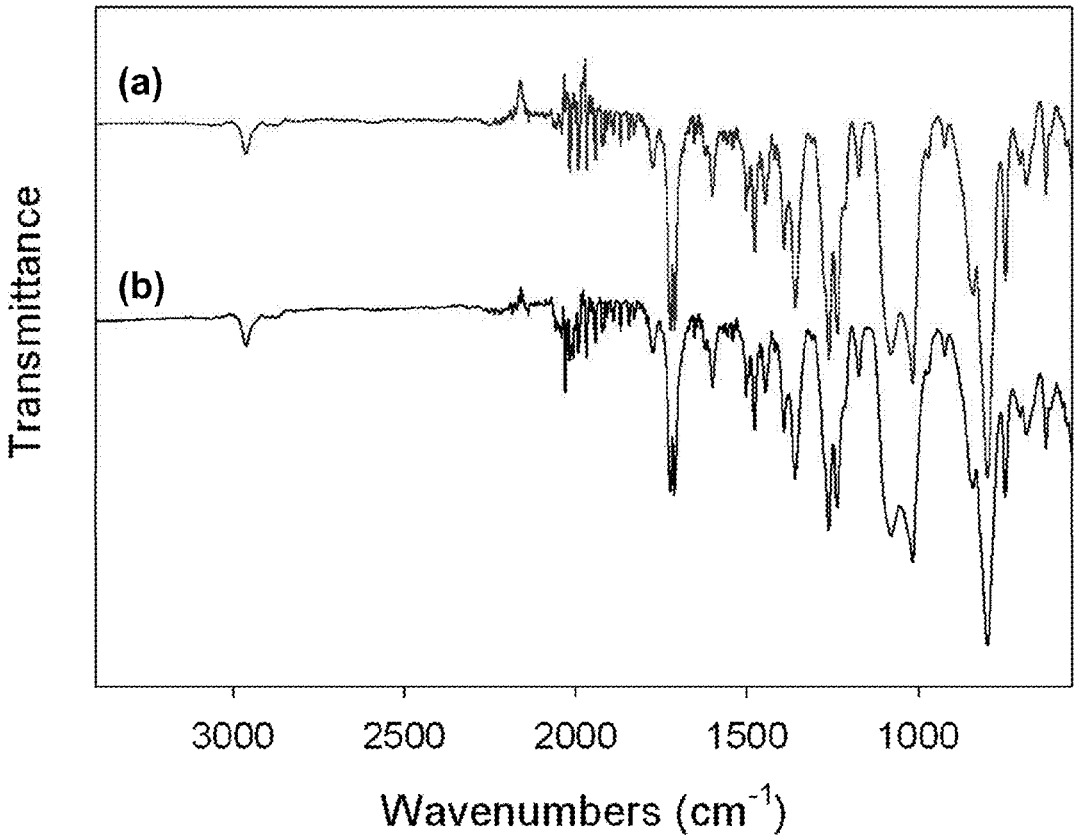

FIG. 8 depicts FTIR-ATR spectra of (a) the as-POSS-$NH_3^+$/$TiO_2$-coated PSEI electrospun mat and (b) the same sample after 10 h of UV illumination.

Figure 9:
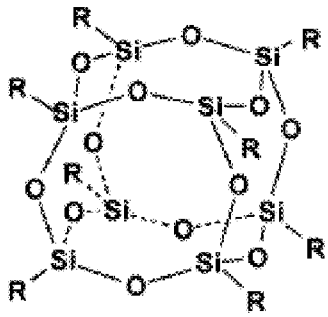
Figure 9:
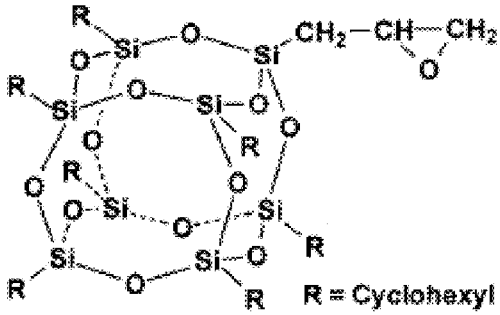
Figure 9:
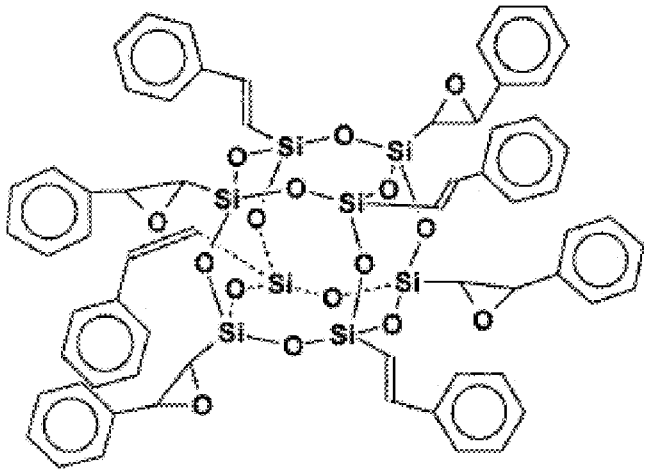

FIG. 9 depicts selected polyhedral oligomeric silsesquioxane (POSS) molecules.

Figure 10:
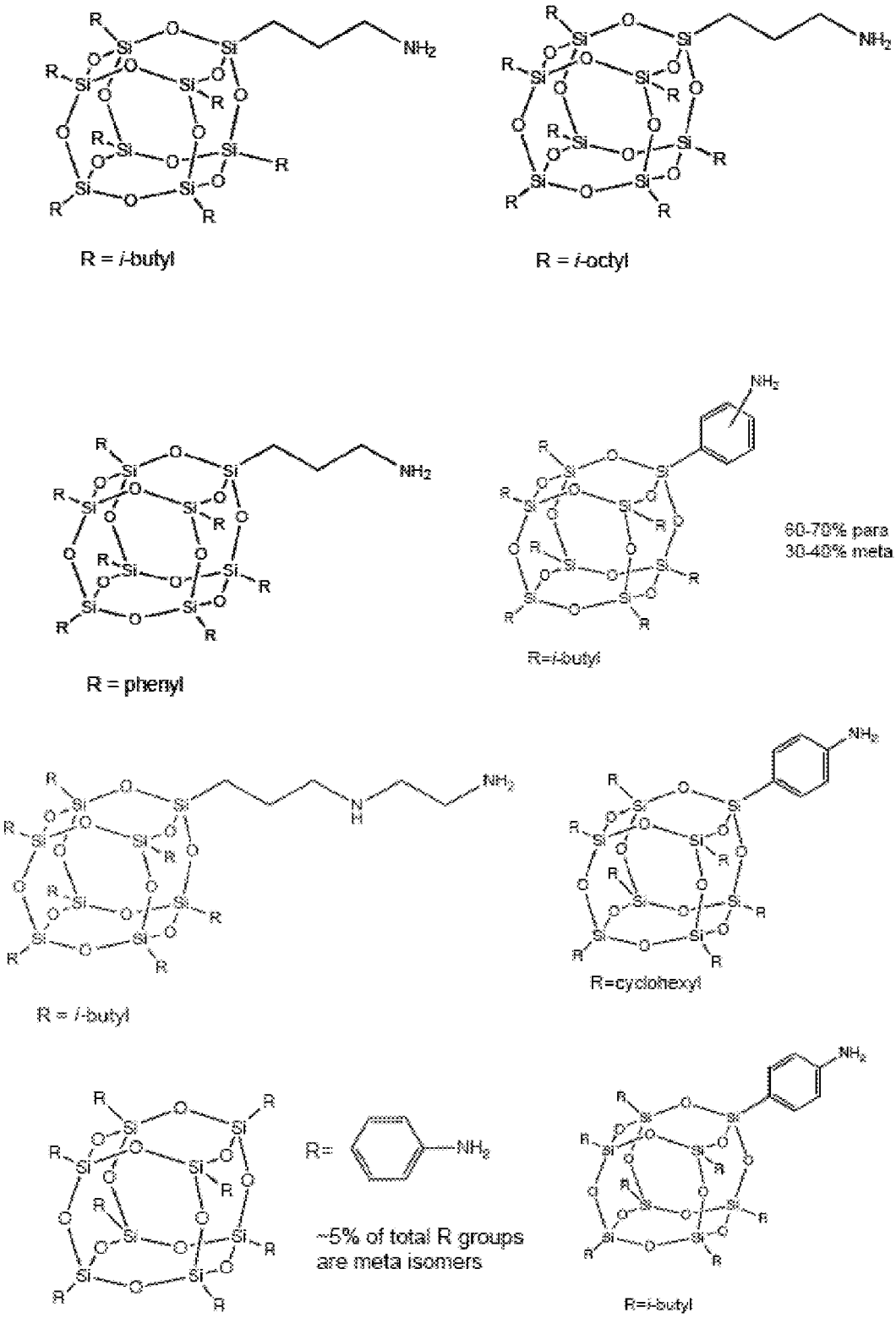

FIG. 10 depicts selected polyhedral oligomeric silsesquioxane (POSS) molecules.

Figure 11:
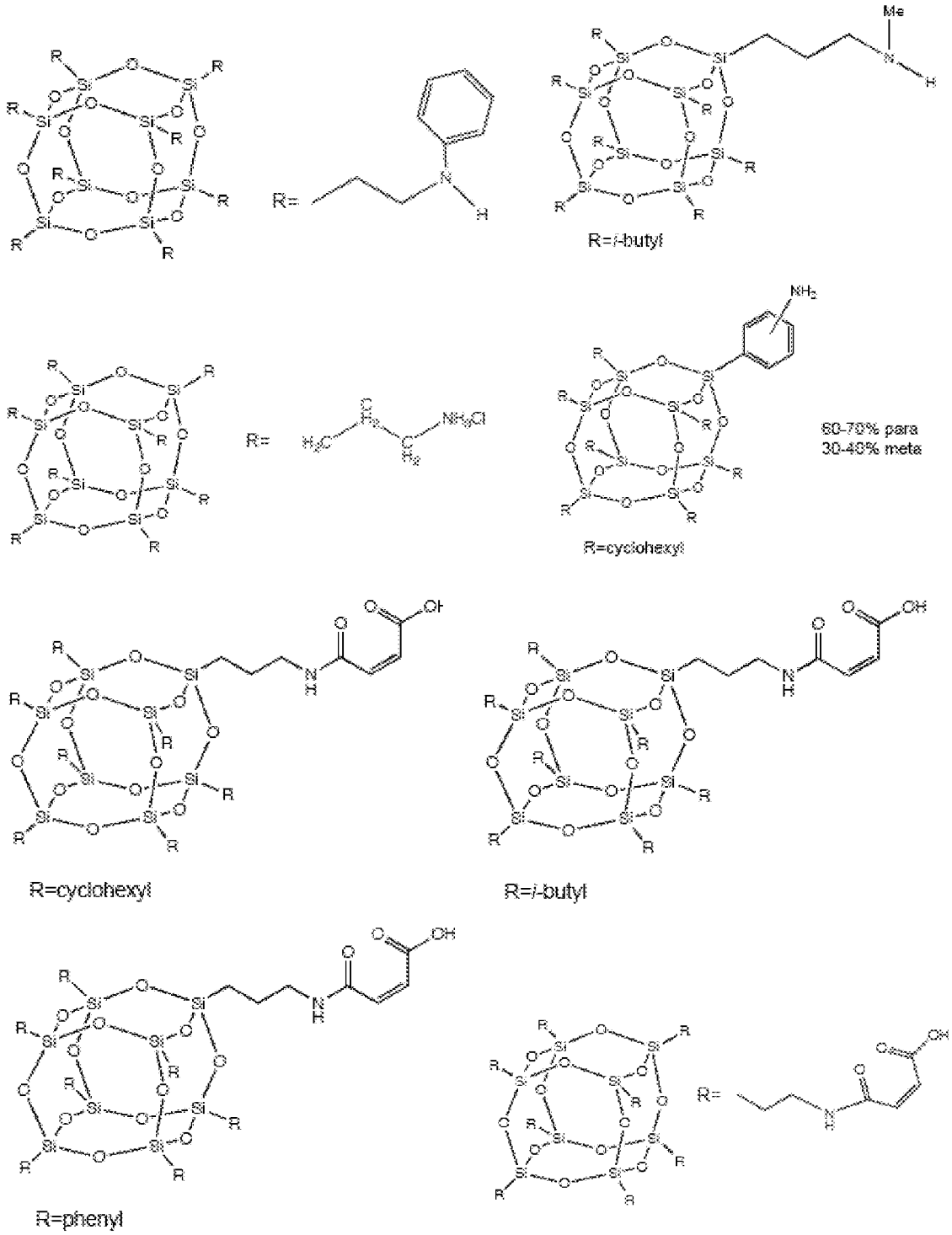

FIG. 11 depicts selected polyhedral oligomeric silsesquioxane (POSS) molecules.

Figure 12:
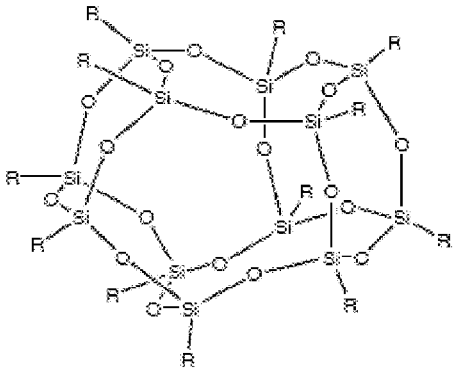
Figure 12:
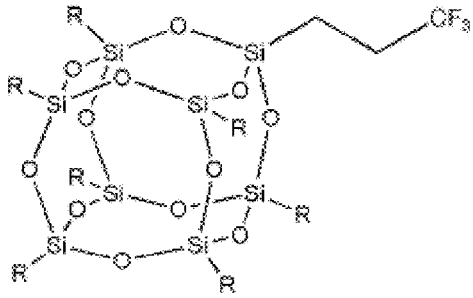
Figure 12:
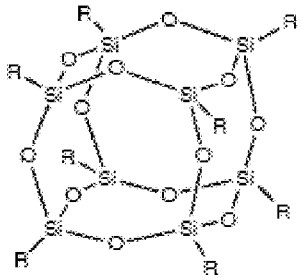
Figure 12:
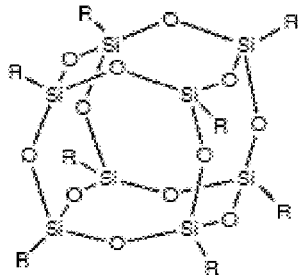

FIG. 12 depicts selected polyhedral oligomeric silsesquioxane (POSS) molecules.

DETAILED DESCRIPTION

Preparation of Multilayer, Polyelectrolyte Thin Films on Substrates by Layer-by-Layer (Lbl) deposition is a well-known technique for forming thin films. The technique has been utilized to deposit (1) complementarily-charged polyelectrolytes, (2) pairs of hydrogen bonding polymers, and (3) positively and negatively charged nanoparticles, onto selected substrates. For example, LbL has been used to deposit nanotitania and silver nanoparticles onto substrates. Ahn, J. S.; Hammond, P. T.; Rubner, M. F.; Lee, I., *Colloids and Surfaces A* 2005, 259(1-3), 45-53; Lowman, G. M.; Hammond, P. T. *Small* 2005, 1(11), 1070-1073; Lee, D.; Cohen, R. E.; Rubner, M. F. *Langmuir* 2005, 21(21), 9651-9659; and Ding, B.; Kim, J.; Kimura, E.; Shiratori, S. *Nanotechnology* 2004. 15(8), 913-917. The structure and formation of such films has been reviewed by Abu-Sharkh including the incorporation of charged particles into the films. Abu-Sharkh, B. F. *Polymer* 2006, 47(10), 3674-3680; and Abu-Sharkh, B. *Langmuir* 2006, 22(7), 3028-3034. LbL techniques have also been used to coat electrospun fiber. Drew, C.; Wang, X. Y.; Samuelson, L. A.; Kumar, J., *Polymeric Nanofibers* 2006, 137-148; and Muller, K.; Quinn, J. F.; Johnston, A. P. R.; Becker, M.; Greiner, A.; Caruso, F., *Chemistry of Materials* 2006, 18(9), 2397-2403 In addition, an automated spray methodology to speed up the LbL process has been developed. K. C. Krogman, N. S. Zacharia, D. M. Grillo, P. T. Hammond, *Chem. Mater.* 2008, 20, 1924; and International Patent Application No.: PCT/US2007/019371, hereby incorporated by reference in its entirety.

One aspect of the present invention relates to the use of a plurality of positively-charged molecules, as opposed to polycationic polymers (see, for example, K. C. Krogman, N. S. Zacharia, D. M. Grillo, P. T. Hammond, *Chem. Mater.* 2008, 20, 1924), to fabricate metal-oxide coated thin films with improved properties. Remarkably, as described herein, the use of positively-charged molecules in place of cationic polymers greatly improves the qualities of such thin films. Some of the potential advantages of the methods disclosed herein are that: (1) they result in a simple, universal coatings which can be applied to most organic and/or metal oxide surfaces, (2) compared to the metal oxide nanofibers prepared by direct electrospinning of a metal oxide precursor polymer solution, calcination is unnecessary and the fibers are more flexible, (3) many different cationic materials (as opposed to polycationic polymers) can be used in the LbL process, depending on application, which allows introduction of additional functionality, and (4) using the electrospinning technique, many different polymers can be formed to create the high specific surface area substrate, and the flexibility of the polymer fiber is retained after the metal oxide LbL nanoparticle coating.

In certain embodiments, the substrate is a fiber, such as an electrospun fiber. In certain embodiments, the substrate is pretreated with a plasma so as to form a negatively-charged substrate, before the LbL deposition. In certain embodiments, the fibers are elecrospun from poly(dimethylsiloxane-b-etherimide) (PSEI).

In certain embodiments, polyhedral oligomeric silsesquioxanes (POSS) are used as the cationic component or the anionic component is the LbL coating. Selected POSS are shown in FIGS. 10-12; some polyhedral oligomeric silsesquioxanes are shown to be useful to preserve or improve the thermal and chemical properties of the polymer fibers, as well as their resistance against UV degradation. In certain embodiments, the polyhedral oligomeric silsesquioxane used is octa (3-ammoniumpropyl)octasilsesquioxane (CAS No. 150380-11-3).

In certain embodiments, negatively-charged titania is used as the metal oxide. Although there have been previous efforts to either decrease the size of $TiO_2$ particles or prepare the nanoscaled fibrous structures using electrospinning from the $TiO_2$ precursor mixed solutions, there have been relatively few attempts to deposit anatase $TiO_2$ nanoparticles onto electrospun nanofibers via post treatment of the fibers, as is described herein. For some previous attempts, see Sugimoto, T.; Zhou, X.; Muramatsu, A. *J. Colloid Interface Sci.* 2002, 259, 53; Sugimoto, T.; Zhou, X.; Muramatsu, A. *J. Colloid Interface Sci.* 2002, 259, 43; Drew, C.; Liu, X.; Ziegler, D.; Wang, X. Y.; Bruno, F. F.; Whitten, J.; Samuelson, L. A.; Kumar, J. *Nano Lett.* 2003, 3, 143; and Li, D.; Xia, Y. N. *Nano Lett.* 2003, 3, 555; and Ding, B.; Kim, J.; Kimura, E.; Shiratori, S. *Nanotechnology* 2004. 15(8), 913-917.

Details on a facile method to prepare high surface area, photocatalytically-active, $TiO_2$-decorated polymer fiber mats is provided in the Exemplification below. In general, negatively charged anatase $TiO_2$ nanoparticles were applied to the surfaces of electrospun polymer fibers using an LbL nanoparticle assembly technique. The positively charged POSS molecule, which is used as the cation for $TiO_2$ coating, is believed to enhance the stability of the original substrates against thermal, chemical, and UV degradation. The high surface areas of electrospun mats enhanced by the LbL dense coating with $TiO_2$ nanoparticles and POSS molecules resulted in significant photocatalytic activity, as evidenced by the degradation of allyl alcohol under mild UV conditions without degradation of electrospun mat.

The methods disclosed herein for the efficient $TiO_2$ coating are straightforward and believed to be applicable to any substrate that can be treated to exhibit a surface charge for various applications, such as a protective clothing system, woven fabric, a non-woven fabric, a filter, an adsorbant, sensors, and electrodes. The use of electrospun fiber mats as a substrate provides a robust material with high surface area and mechanical integrity that is ideal for such applications.

Definitions

For convenience, certain terms employed in the specification, examples, and appended claims are collected here.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e., "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The term "surface" or "substrate" as used herein can mean any surface of any material, including glass, plastics, metals, polymers, and like. It can include surfaces constructed out of more than one material, including coated surfaces. Non-limiting examples of surfaces include nylons, polyesters, polyurethanes, polyanhydrides, polyorthoesters, polyacrylonitriles, polyphenazines, latex, Teflon, Dacron, acrylates, methacrylates, chlorinated rubber, fluoropolymers, polyamide resins, vinyl resins, polyethylene, polypropylene, and poly(ethylene terephthalate). In certain embodiments, the surfaces of the instant invention are electrospun fibers and mats thereof. In certain embodiments, the electrospun fibers are electrospun from polystyrene (PS), polyacrylonitrile (PAN), a blend of poly(methyl methacrylate) (PMMA) and poly(ethylene oxide) (PEO), or poly(dimethylsiloxane-b-etherimide) (PSEI).

As discussed below, certain aspects of the invention relate to surfaces which comprises of one or more "electrospun fibers". As used herein, a electrospun fibers may be fabricated from any material that can dissolve or decompose upon exposure to certain solvents or high temperatures.

As used herein, the electrospinnable fiber may be comprised of a homopolymer, a copolymer, or a blend of polymers selected from the group consisting of alginates, aromatic copolyesters, cellulose acetates, cellulose nitrites, collagens, ethylene-methacrylic acid copolymers, ethylene-vinyl acetate copolymers, fluoropolymers, modified celluloses, neoprenes, polyp-xylylene), polyacrylamides, polyacrylates, polyacrylonitriles, polyamides, polyacrylamides, polyarylenevinylenes, polybenzimidazoles, polybenzothiazoles, polybutadienes, polybutenes, polycarbonates, polyesters, polyether ketones, polyethers, polyethylenes, polyhydroxyethyl methacrylates, polyimides, polylactides, polylactones, polymethacrylates, polymethacrylonitriles, polymethylmethacrylates, poly-N-vinylpyrrolidones, polyolefins, polyoxazoles, polyphenylene, polypropylenes, polysilanes, polysiloxanes, polystyrenes, polysulfides, polysulfones, polytetrafluoroethylenes, polyurethanes, polyvinyl acetates, polyvinylacetate-methacrylic copolymers, polyvinylidene chlorides and unmodified celluloses.

In addition, the electrospinnable fiber may be comprised of a homopolymer, a copolymer or a blend of polymers selected from the group consisting of polyisobutylenes, polyolefins, halogen-containing polymers, silicon-containing polymers (e.g., polysiloxanes), polystyrenes, polyacrylates, polyurethanes, polyesters, polyamides, collagens, silks, cellulosics and any derivatives thereof or combination thereof.

Further, the electrospun fiber may be comprised of a natural protein polymers (e.g., silk or actin), natural polysaccharides (e.g., collagen). In certain embodiments, the electrospinnable fiber is comprised of non-natural protein polymers or polysaccharides.

In particular instances, the electrospun polymer fiber may be electrospun from polystyrene (PS), polyacrylonitrile (PAN), a blend of poly(methyl methacrylate) (PMMA) and poly(ethylene oxide) (PEO), or poly(dimethylsiloxane-b-etherimide) (PSEI).

Surfaces (such as electrospun polymer fibers or mats formed thereof) may be "rough". A rough surface, as used herein, refers to a marked by irregularities, protuberances, or ridges. Surface fabrication conditions or post fabrication modifications can create a rough surface. For an electrospun fiber, a rough surface may be obtained by proper selection of polymers, solvents, and/or electrospinning conditions. M. Bognitzki, W. Czado, T. Frese, A. Schaper, M. Hellwig, M.

Steinhart, A. Greiner, J. H. Wendorff, *Adv. Mater.* 2001, 13, 70. For example, when the electrospinning solution becomes thermodynamically unstable due to solvent evaporation, the occurrence of phase separation into a polymer-rich and a polymer-deficient phase may lead to formation of such surface roughness. In the instant invention, this surface roughness creates additional surface area that may affect the coating. One of skill in the art can determine without undue experimentation how to increase the roughness of any given electrospun fiber or other surface (e.g. by inducing mixed or hierarchical roughness into the fiber).

The term "electrolyte" as used herein means any chemical compound that ionizes when dissolved. The term "polyanionic layer" refers to a layer comprising a plurality of negatively charged molecules or a negatively charged polymer. The term "polycationic layer" refers to a layer comprising a plurality of positively charged molecules or a positively charged polymer.

The term "bilayer" is employed herein in a broad sense and is intended to encompass a coating structure formed by alternatively applying, in no particular order, one layer of a first material and one layer of a second material. It should be understood that the layers of the first material and the second material may be intertwined with each other in the bilayer.

The term "pH" as used herein means a measure of the acidity or alkalinity of a solution, equal to 7, for neutral solutions and increasing to 14 with increasing alkalinity and decreasing to 0 with increasing acidity. The term "pH dependent" as used herein means a weak electrolyte or polyelectrolyte, such as polyacrylic acid, in which the charge density can be adjusted by adjusting the pH. The term "pH independent" as used herein means a strong electrolyte or polyelectrolyte, such as polystyrene sulfonate, in which the ionization is complete or nearly complete and does not change appreciably with pH.

The term "nanoscopic molecules" as used herein refers to a molecule the structure of which essentially comprises the multiple repetition of units derived, actually or conceptually, from molecules of low relative molecular mass; polyhedral oligomeric silsesquioxanes, discussed below, are nanoscopic molecules.

As used herein, the term "silsesquioxane" refers to silicon structures having the empirical formula $RSiO_{3/2}$, wherein R can be hydrogen or carbon moieties, such as aryl or alkyl fragments with or without unsaturation and can contain functionalities, such as amino or epoxy groups. The multifunctional nature of the silsesquioxane allows for a variety of structures such as oligomeric full or partial cages, ordered ladder structures or three dimensional networks. A special group of the silsesquioxane family is the polyhedral oligomeric silsesquioxanes (POSS). POSS present two unique features: a hybrid chemical composition ($RSiO_{1-5}$) intermediate between silica ($SiO_2$) and silicone ($R_2SiO$); and a physically large, cage-like, intrinsic nano-structured molecular structure. Therefore, POSS can be defined as intrinsically nano-structured organic-inorganic compounds. POSS are single molecules of nanoscopic size, larger than small molecules but smaller than macromolecules, ranging from 0.7 to 50 nm, having a well defined three-dimensional polyhedral structure. Unlike silica and modified clays, each POSS molecule may contain covalently bonded functional groups. POSS molecules are tailorable, meaning that these functional groups can be varied and changed to give different properties to the molecule. The basic form is the POSS molecular silica containing a robust SiO core surrounded by non-reactive organic groups, which permits the inorganic core to be compatible with an organic matrix. These kind of molecules can be used as nanocomposites with molecular level dispersion. Different functional groups may be added to this basic form to give POSS functionalized monomers such as without limitation: alcohols, phenols, alkoxysilanes, amines, chlorosilanes, halides, fluoroalkyls, acrylates and methacrylates, epoxides, esters, nitriles, olefins, phosphines, silanes, silanols, thiols and fluoroalkyls. POSS functional monomers may contain between one to various reactive organic groups; for example, see FIGS. 9-12. Both positively-charged and negatively-charged POSS molecules can be utilized in the invention (paired with complementarily charged metal oxides, in some embodiments).

As used herein, the term "roughness" includes both mixed roughness (such as beads on a string) as well as hierarchical roughness (wherein a finer-scale structure is "decorated" onto a coarser-scale feature of a surface). For a discussion of the different types of roughness, see, for example, M. L. Ma, R. M. Hill, J. L. Lowery, S. V. Fridrikh, G. C. Rutledge, *Langmuir* 2005, 21, 5549; J. A. Lee, T. J. McCarthy, *Macromolecules* 2007, 40, 3965; and M. L. Ma, M. Gupta, Z. Li, L. Zhai, K. K. Gleason, R. E. Cohen, M. F. Rubner, G. C. Rutledge, *Adv. Mater.* 2007, 19, 255.

For purposes of this invention, the chemical elements are identified in accordance with the Periodic Table of the Elements, CAS version, Handbook of Chemistry and Physics, 67th Ed., 1986-87, inside cover.

The term "heteroatom" is art-recognized and refers to an atom of any element other than carbon or hydrogen. Illustrative heteroatoms include boron, nitrogen, oxygen, phosphorus, sulfur and selenium.

The term "alkyl" is art-recognized, and includes saturated aliphatic groups, including straight-chain alkyl groups, branched-chain alkyl groups, cycloalkyl (alicyclic) groups, alkyl substituted cycloalkyl groups, and cycloalkyl substituted alkyl groups. In certain embodiments, a straight chain or branched chain alkyl has about 80 or fewer carbon atoms in its backbone (e.g., $C_1$-$C_{80}$ for straight chain, $C_3$-$C_{80}$ for branched chain), and alternatively, about 30 or fewer. Likewise, cycloalkyls have from about 3 to about 10 carbon atoms in their ring structure, and alternatively about 5, 6 or 7 carbons in the ring structure.

Unless the number of carbons is otherwise specified, "lower alkyl" refers to an alkyl group, as defined above, but having from one to about ten carbons, alternatively from one to about six carbon atoms in its backbone structure. Likewise, "lower alkenyl" and "lower alkynyl" have similar chain lengths.

The term "fluoroalkyl" is art-recognized, and as used herein, pertains to an alkyl group in which one or more hydrogens have been replaced with fluorines (such as, for example, $—CF_3$, $—CF_2CF_3$, $—CH_2CF_3$, and $—CH_2CH_2F$).

The term "alkylene," is art-recognized, and as used herein, pertains to a bidentate moiety obtained by removing two hydrogen atoms, either both from the same carbon atom, or one from each of two different carbon atoms, of a hydrocarbon compound, which may be aliphatic or alicyclic, or a combination thereof, and which may be saturated, partially unsaturated, or fully unsaturated. Examples of linear saturated $C_{1-10}$alkylene groups include, but are not limited to, $—(CH_2)—$ where n is an integer from 1 to 10, for example, $—CH_2—$ (methylene), $—CH_2CH_2—$ (ethylene), $—CH_2CH_2CH_2—$ (propylene), $—CH_2CH_2CH_2CH_2—$ (butylene), $—CH_2CH_2CH_2CH_2CH_2$-(pentylene) and $—CH_2CH_2CH_2CH_2CH_2CH_2—$ (hexylene). Examples of branched saturated $C_{1-10}$alkylene groups include, but are not limited to, $—CH(CH_3)—$, $—CH(CH_3)CH_2—$, $—CH(CH_3)CH_2CH_2—$, $—CH(CH_3)CH_2CH_2CH_2—$, $—CH_2CH(CH_3)$ $CH_2$—, —$CH_2CH(CH_3)CH_2CH_2$—, —$CH(CH_2CH_3)$—, —$CH(CH_2CH_3)CH_2$—, and —$CH_2CH(CH_2CH_3)CH_2$—. Examples of linear partially unsaturated $C_{1-10}$alkylene groups include, but are not limited to, —CH═CH— (vinylene), —CH═CH—$CH_2$—, —CH═CH—$CH_2$—$CH_2$—, —CH═CH—$CH_2$—$CH_2$—$CH_2$—, —CH═CH—CH═CH—, —CH═CH—CH═CH—$CH_2$—, —CH═CH—CH═CH—$CH_2$—$CH_2$—, —CH═CH—$CH_2$—CH═CH—, and —CH═CH—$CH_2$—$CH_2$—CH═CH—. Examples of branched partially unsaturated $C_{1-10}$alkylene groups include, but are not limited to, —$C(CH_3)$═CH—, —$C(CH_3)$═CH—$CH_2$—, and —CH═CH—$CH(CH_3)$—. Examples of alicyclic saturated $C_{1-10}$alkylene groups include, but are not limited to, cyclopentylene (e.g., cyclopent-1,3-ylene), and cyclohexylene (e.g., cyclohex-1,4-ylene). Examples of alicyclic partially unsaturated $C_{1-10}$alkylene groups include, but are not limited to, cyclopentenylene (e.g., 4-cyclopenten-1,3-ylene), and cyclohexenylene (e.g., 2-cyclohexen-1,4-ylene, 3-cyclohexen-1,2-ylene, and 2,5-cyclohexadien-1,4-ylene).

The term "arylene," is art-recognized, and as used herein, pertains to a bidentate moiety obtained by removing two hydrogen atoms, either both from the same carbon atom, or one from each of two different carbon atoms, of an aromatic ring, as defined below for aryl (the corresponding monodentate moiety).

The term "heteroarylene," is art-recognized, and as used herein, pertains to a bidentate moiety obtained by removing two hydrogen atoms, either both from the same carbon atom, or one from each of two different carbon atoms, of a heteroaromatic ring, as defined below for heteroaryl (the corresponding monodentate moiety).

The term "aralkyl" is art-recognized and refers to an alkyl group substituted with an aryl group (e.g., an aromatic or heteroaromatic group).

The terms "alkenyl" and "alkynyl" are art-recognized and refer to unsaturated aliphatic groups analogous in length and possible substitution to the alkyls described above, but that contain at least one double or triple bond respectively.

The term "aryl" is art-recognized and refers to 5-, 6- and 7-membered single-ring aromatic groups that may include from zero to four heteroatoms, for example, benzene, naphthalene, anthracene, pyrene, pyrrole, furan, thiophene, imidazole, oxazole, thiazole, triazole, pyrazole, pyridine, pyrazine, pyridazine and pyrimidine, and the like. Those aryl groups having heteroatoms in the ring structure may also be referred to as "aryl heterocycles" or "heteroaromatics." The aromatic ring may be substituted at one or more ring positions with such substituents as described herein, for example, halogen, azide, alkyl, aralkyl, alkenyl, alkynyl, cycloalkyl, hydroxyl, alkoxyl, amino, nitro, sulfhydryl, imino, amido, phosphonate, phosphinate, carbonyl, carboxyl, silyl, alkylthio, sulfonyl, sulfonamido, ketone, aldehyde, ester, heterocyclyl, aromatic or heteroaromatic moieties, trifluoromethyl, cyano, or the like. The term "aryl" also includes polycyclic ring systems having two or more cyclic rings in which two or more carbons are common to two adjoining rings (the rings are "fused rings") wherein at least one of the rings is aromatic, e.g., the other cyclic rings may be cycloalkyls, cycloalkenyls, cycloalkynyls, aryls and/or heterocyclyls.

The terms ortho, meta and para are art-recognized and refer to 1,2-, 1,3- and 1,4-disubstituted benzenes, respectively. For example, the names 1,2-dimethylbenzene and ortho-dimethylbenzene are synonymous.

The terms "heterocyclyl", "heteroaryl", or "heterocyclic group" are art-recognized and refer to 3- to about 10-membered ring structures, alternatively 3- to about 7-membered rings, whose ring structures include one to four heteroatoms. Heterocycles may also be polycycles. Heterocyclyl groups include, for example, thiophene, thianthrene, furan, pyran, isobenzofuran, chromene, xanthene, phenoxanthene, pyrrole, imidazole, pyrazole, isothiazole, isoxazole, pyridine, pyrazine, pyrimidine, pyridazine, indolizine, isoindole, indole, indazole, purine, quinolizine, isoquinoline, quinoline, phthalazine, naphthyridine, quinoxaline, quinazoline, cinnoline, pteridine, carbazole, carboline, phenanthridine, acridine, pyrimidine, phenanthroline, phenazine, phenarsazine, phenothiazine, furazan, phenoxazine, pyrrolidine, oxolane, thiolane, oxazole, piperidine, piperazine, morpholine, lactones, lactams such as azetidinones and pyrrolidinones, sultams, sultones, and the like. The heterocyclic ring may be substituted at one or more positions with such substituents as described above, as for example, halogen, alkyl, aralkyl, alkenyl, alkynyl, cycloalkyl, hydroxyl, amino, nitro, sulfhydryl, imino, amido, phosphonate, phosphinate, carbonyl, carboxyl, silyl, alkylthio, sulfonyl, ketone, aldehyde, ester, a heterocyclyl, an aromatic or heteroaromatic moiety, trifluoromethyl, cyano, or the like.

The term "nitro" is art-recognized and refers to —$NO_2$; the term "halogen" is art-recognized and refers to —F, —Cl, —Br or —I; the term "sulfhydryl" is art-recognized and refers to —SH; the term "hydroxyl" means —OH; and the term "sulfonyl" is art-recognized and refers to —$SO_2^-$. "Halide" designates the corresponding anion of the halogens, and "pseudohalide" has the definition set forth on page 560 of "Advanced Inorganic Chemistry" by Cotton and Wilkinson, that is, for example, monovalent anionic groups sufficiently electronegative to exhibit a positive Hammett sigma value at least equaling that of a halide (e.g., CN, OCN, SCN, SeCN, TeCN, $N_3$, and $C(CN)_3$).

The terms "amine" and "amino" are art-recognized and refer to both unsubstituted and substituted amines, e.g., a moiety that may be represented by the general formulas:

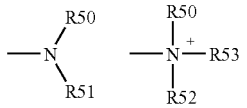

wherein R50, R51, R52 and R53 each independently represent a hydrogen, an alkyl, an alkenyl, —$(CH_2)_m$—R61, or R50 and R51 or R52, taken together with the N atom to which they are attached complete a heterocycle having from 4 to 8 atoms in the ring structure; R61 represents an aryl, a cycloalkyl, a cycloalkenyl, a heterocycle or a polycycle; and m is zero or an integer in the range of 1 to 8. In other embodiments, R50 and R51 (and optionally R52) each independently represent a hydrogen, an alkyl, an alkenyl, or —$(CH_2)_m$—R61. Thus, the term "alkylamine" includes an amine group, as defined above, having a substituted or unsubstituted alkyl attached thereto, i.e., at least one of R50 and R51 is an alkyl group.

The term "acylamino" is art-recognized and refers to a moiety that may be represented by the general formula:

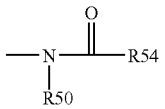

wherein R50 is as defined above, and R54 represents a hydrogen, an alkyl, an alkenyl or —$(CH_2)_m$—R61, where m and R61 are as defined above.

The term "amido" is art recognized as an amino-substituted carbonyl and includes a moiety that may be represented by the general formula:

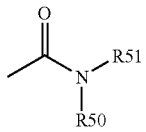

wherein R50 and R51 are as defined above. Certain embodiments of the amide in the present invention will not include imides which may be unstable.

The term "alkylthio" refers to an alkyl group, as defined above, having a sulfur radical attached thereto. In certain embodiments, the "alkylthio" moiety is represented by one of —S-alkyl, —S-alkenyl, —S-alkynyl, and —S—$(CH_2)_m$—R61, wherein m and R61 are defined above. Representative alkylthio groups include methylthio, ethyl thio, and the like.

The term "carboxyl" is art recognized and includes such moieties as may be represented the two general formulas shown below:

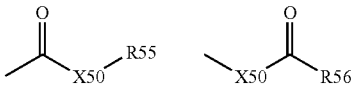

wherein X50 is a bond or represents an oxygen or a sulfur, and R55 and R56 represents a hydrogen, an alkyl, an alkenyl, —$(CH_2)_m$—R61 or a pharmaceutically acceptable salt, R56 represents a hydrogen, an alkyl, an alkenyl or —$(CH_2)_m$—R61, where m and R61 are defined above. Where X50 is an oxygen and $R_{55}$ or R56 is not hydrogen, the formula represents an "ester". Where X50 is an oxygen, and R55 is as defined above, the moiety is referred to herein as a carboxyl group, and particularly when R55 is a hydrogen, the formula represents a "carboxylic acid". Where X50 is an oxygen, and R56 is hydrogen, the formula represents a "formate". In general, where the oxygen atom of the above formula is replaced by sulfur, the formula represents a "thiolcarbonyl" group. Where X50 is a sulfur and R55 or R56 is not hydrogen, the formula represents a "thiolester." Where X50 is a sulfur and R55 is hydrogen, the formula represents a "thiolcarboxylic acid." Where X50 is a sulfur and R56 is hydrogen, the formula represents a "thiolformate." On the other hand, where X50 is a bond, and R55 is not hydrogen, the above formula represents a "ketone" group. Where X50 is a bond, and R55 is hydrogen, the above formula represents an "aldehyde" group.

The term "carbamoyl" refers to —O(C═O)NRR', where R and R' are independently H, aliphatic groups, aryl groups or heteroaryl groups.

The term "oxo" refers to a carbonyl oxygen (═O).

The terms "oxime" and "oxime ether" are art-recognized and refer to moieties that may be represented by the general formula:

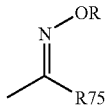

wherein R75 is hydrogen, alkyl, cycloalkyl, alkenyl, alkynyl, aryl, aralkyl, or —$(CH_2)_m$—R61. The moiety is an "oxime" when R is H; and it is an "oxime ether" when R is alkyl, cycloalkyl, alkenyl, alkynyl, aryl, aralkyl, or —$(CH_2)_m$—R61.

The terms "alkoxyl" or "alkoxy" are art-recognized and refer to an alkyl group, as defined above, having an oxygen radical attached thereto. Representative alkoxyl groups include methoxy, ethoxy, propyloxy, tert-butoxy and the like. An "ether" is two hydrocarbons covalently linked by an oxygen. Accordingly, the substituent of an alkyl that renders that alkyl an ether is or resembles an alkoxyl, such as may be represented by one of —O-alkyl, —O-alkenyl, —O-alkynyl, —O—$(CH_2)_m$—R61, where m and R61 are described above.

The term "sulfonate" is art recognized and refers to a moiety that may be represented by the general formula:

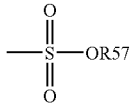

in which R57 is an electron pair, hydrogen, alkyl, cycloalkyl, or aryl.

The term "sulfate" is art recognized and includes a moiety that may be represented by the general formula:

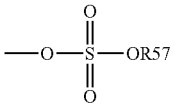

in which R57 is as defined above.

The term "sulfonamido" is art recognized and includes a moiety that may be represented by the general formula:

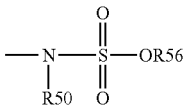

in which R50 and R56 are as defined above.

The term "sulfamoyl" is art-recognized and refers to a moiety that may be represented by the general formula:

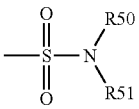

in which R50 and R51 are as defined above.

The term "sulfonyl" is art-recognized and refers to a moiety that may be represented by the general formula:

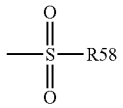

in which R58 is one of the following: hydrogen, alkyl, alkenyl, alkynyl, cycloalkyl, heterocyclyl, aryl or heteroaryl.

The term "sulfoxido" is art-recognized and refers to a moiety that may be represented by the general formula:

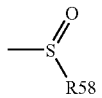

in which R58 is defined above.

The term "phosphoryl" is art-recognized and may in general be represented by the formula:

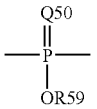

wherein Q50 represents S or O, and R59 represents hydrogen, a lower alkyl or an aryl. When used to substitute, e.g., an alkyl, the phosphoryl group of the phosphorylalkyl may be represented by the general formulas:

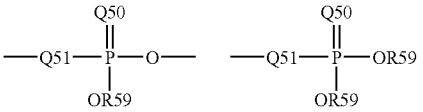

wherein Q50 and R59, each independently, are defined above, and Q51 represents O, S or N. When Q50 is S, the phosphoryl moiety is a "phosphorothioate".

The term "phosphoramidite" is art-recognized and may be represented in the general formulas:

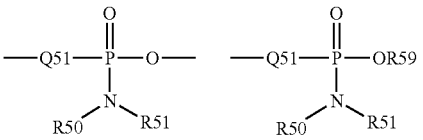

wherein Q51, R50, R51 and R59 are as defined above.

The term "phosphonamidite" is art-recognized and may be represented in the general formulas:

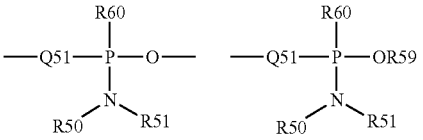

wherein Q51, R50, R51 and R59 are as defined above, and R60 represents a lower alkyl or an aryl.

Analogous substitutions may be made to alkenyl and alkynyl groups to produce, for example, aminoalkenyls, aminoalkynyls, amidoalkenyls, amidoalkynyls, iminoalkenyls, iminoalkynyls, thioalkenyls, thioalkynyls, carbonyl-substituted alkenyls or alkynyls.

The term "selenoalkyl" is art-recognized and refers to an alkyl group having a substituted seleno group attached thereto. Exemplary "selenoethers" which may be substituted on the alkyl are selected from one of —Se-alkyl, —Se-alkenyl, —Se-alkynyl, and —Se—$(CH_2)_m$—R61, m and R61 being defined above.

The terms triflyl, tosyl, mesyl, and nonaflyl are art-recognized and refer to trifluoromethanesulfonyl, p-toluenesulfonyl, methanesulfonyl, and nonafluorobutanesulfonyl groups, respectively. The terms triflate, tosylate, mesylate, and nonaflate are art-recognized and refer to trifluoromethanesulfonate ester, p-toluenesulfonate ester, methanesulfonate ester, and nonafluorobutanesulfonate ester functional groups and molecules that contain said groups, respectively.

The definition of each expression, e.g., alkyl, m, n, and the like, when it occurs more than once in any structure, is intended to be independent of its definition elsewhere in the same structure.

The abbreviations Me, Et, Ph, Tf, Nf, Ts, and Ms represent methyl, ethyl, phenyl, trifluoromethanesulfonyl, nonafluorobutanesulfonyl, p-toluenesulfonyl and methanesulfonyl, respectively. A more comprehensive list of the abbreviations utilized by organic chemists of ordinary skill in the art appears in the first issue of each volume of the Journal of Organic Chemistry; this list is typically presented in a table entitled Standard List of Abbreviations.

Certain compounds contained in compositions of the present invention may exist in particular geometric or stereoisomeric forms. In addition, polymers of the present invention may also be optically active. The present invention contemplates all such compounds, including cis- and trans-isomers, R- and S-enantiomers, diastereomers, (D)-isomers, (L)-isomers, the racemic mixtures thereof, and other mixtures thereof, as falling within the scope of the invention. Additional asymmetric carbon atoms may be present in a substituent such as an alkyl group. All such isomers, as well as mixtures thereof, are intended to be included in this invention.

If, for instance, a particular enantiomer of compound of the present invention is desired, it may be prepared by asymmetric synthesis, or by derivation with a chiral auxiliary, where the resulting diastereomeric mixture is separated and the auxiliary group cleaved to provide the pure desired enantiomers. Alternatively, where the molecule contains a basic functional group, such as amino, or an acidic functional group, such as carboxyl, diastereomeric salts are formed with an appropriate optically-active acid or base, followed by resolution of the diastereomers thus formed by fractional crystallization or chromatographic means well known in the art, and subsequent recovery of the pure enantiomers.

It will be understood that "substitution" or "substituted with" includes the implicit proviso that such substitution is in accordance with permitted valence of the substituted atom and the substituent, and that the substitution results in a stable compound, e.g., which does not spontaneously undergo transformation such as by rearrangement, cyclization, elimination, or other reaction.

The term "substituted" is also contemplated to include all permissible substituents of organic compounds. In a broad aspect, the permissible substituents include acyclic and cyclic, branched and unbranched, carbocyclic and heterocyclic, aromatic and nonaromatic substituents of organic compounds. Illustrative substituents include, for example, those described herein above. The permissible substituents may be one or more and the same or different for appropriate organic compounds. For purposes of this invention, the heteroatoms, such as nitrogen, may have hydrogen substituents and/or any permissible substituents of organic compounds described herein which satisfy the valences of the heteroatoms. This invention is not intended to be limited in any manner by the permissible substituents of organic compounds.

Coating Methods

One aspect of the invention relates to a method of forming a coating on a substrate, comprising the steps of:

(a) contacting the substrate with a solution or aerosol comprising a first material, which is either a charged material or a hydrogen bonded donor/acceptor material, to form an adsorbed layer of the first material on the substrate;

(b) optionally rinsing the substrate with a rinsing solution to remove non-bound excess first material from the substrate;

(c) contacting the substrate with a solution or aerosol comprising a second material, which is either a charged material or hydrogen bonded donor/acceptor material and whose charge or hydrogen bond donor/acceptor nature is complementary to the first material, thereby forming an adsorbed layer of the second material on top of the first material to form a bilayer;

(d) optionally rinsing the substrate with a rinsing solution to remove non-bound excess second material from the substrate; and (e) optionally repeating steps (a)-(d) one or more times;

wherein for at least one bilayer, one layer comprises a plurality of positively-charged or negatively-charged metal oxide nanoparticles and the other layer comprises a plurality of complementarily-charged molecules.

In certain embodiments, the present invention relates to any one of the aforementioned methods, wherein for at least one bilayer, one layer comprises a plurality of negatively-charged metal oxide nanoparticles and the other layer comprises a plurality of positively-charged molecules.

In certain embodiments, the present invention relates to any one of the aforementioned methods, wherein for at least one bilayer, one layer comprises a plurality of positively-charged metal oxide nanoparticles and the other layer comprises a plurality of negatively-charged molecules.

In certain embodiments, the present invention relates to any one of the aforementioned methods, wherein a first bilayer and a second bilayer are formed on the substrate; and the first bilayer is not the same as the second bilayer.

In certain embodiments, the present invention relates to any one of the aforementioned methods, wherein at least one of said contacting steps occurs by immersion of the substrate in a solution. In certain embodiments, the present invention relates to any one of the aforementioned methods, wherein at least one of said contacting steps occurs by contacting the substrate with an aerosol (e.g., a "misting" method). For an example of a "misting" method, see International Patent Application No.: PCT/US2007/019371, hereby incorporated by reference in its entirety. In certain embodiments, the present invention relates to any one of the aforementioned methods, wherein at least one of said contacting steps occurs by a "spin assembly" method. For an example of a "spin assembly" method, see J. Seo, J. L. Lutkenhaus, J. Kim, P. T. Hammond, and K. Char, *Langmuir* 2008, 24(15), 7995-8000; hereby incorporated by reference in its entirety.

In certain embodiments, the present invention relates to any one of the aforementioned methods, wherein at least one of said contacting steps occurs by immersion of the substrate in a solution with a pH of from about 5.5 to about 9.5. In certain embodiments, the present invention relates to any one of the aforementioned methods, wherein at least one of said contacting steps occurs by immersion of the substrate in a solution with a pH of about 7.5.

In certain embodiments, the present invention relates to any one of the aforementioned methods, further comprising repeating steps (a) through (d) from 2 to 10 times, inclusive. In certain embodiments, the present invention relates to any one of the aforementioned methods, further comprising repeating steps (a) through (d) from about 10 times to about 30 times. In certain embodiments, the present invention relates to any one of the aforementioned methods, further comprising repeating steps (a) through (d) from about 30 times to about 50 times. In certain embodiments, the present invention relates to any one of the aforementioned methods, further comprising repeating steps (a) through (d) from about 50 times to about 100 times. In certain embodiments, the present invention relates to any one of the aforementioned methods, further comprising repeating steps (a) through (d) from about 100 times to about 200 times.

In certain embodiments, the present invention relates to any one of the aforementioned methods, wherein the metal oxide nanoparticles are alkali metal oxide nanoparticles. In certain embodiments, the present invention relates to any one of the aforementioned methods, wherein the metal oxide nanoparticles are alkaline earth metal oxide nanoparticles. In certain embodiments, the present invention relates to any one of the aforementioned methods, wherein the metal oxide nanoparticles are transition metal oxide nanoparticles. In certain embodiments, the present invention relates to any one of the aforementioned methods, wherein the metal oxide nanoparticles are lanthanide metal oxide nanoparticles. In certain embodiments, the present invention relates to any one of the aforementioned methods, wherein the metal oxide nanoparticles are group IIIA metal oxide nanoparticles. In certain embodiments, the present invention relates to any one of the aforementioned methods, wherein the metal oxide nanoparticles are group IVA metal oxide nanoparticles. In certain embodiments, the present invention relates to any one of the aforementioned methods, wherein the metal oxide nanoparticles are silica nanoparticles, titania nanoparticles, ceria nanoparticles, alumina nanoparticles, zirconia nanoparticles or combinations thereof. In certain embodiments, the present invention relates to any one of the aforementioned methods, wherein the metal oxide nanoparticles are titania nanoparticles. In certain embodiments, the present invention relates to any one of the aforementioned methods, wherein the metal oxide nanoparticles are anatase titania nanoparticles.

In certain embodiments, the present invention relates to any one of the aforementioned methods, wherein the diameter of the metal oxide nanoparticles is from about 1 nm to about 100 nm. In certain embodiments, the present invention relates to any one of the aforementioned methods, wherein the diameter of the metal oxide nanoparticles is from about 1 nm to about 25 nm. In certain embodiments, the present invention relates to any one of the aforementioned methods, wherein the diameter of the metal oxide nanoparticles is from about 5 nm to about 10 nm. In certain embodiments, the present invention relates to any one of the aforementioned methods, wherein the diameter of the metal oxide nanoparticles is about 7 nm.

In certain embodiments, the present invention relates to any one of the aforementioned methods, wherein the complementarily-charged molecules are selected from the group consisting of polyhedral oligomeric silsesquioxanes. In certain embodiments, the present invention relates to any one of the aforementioned methods, wherein the complementarily-charged molecules are selected from the group consisting of monofunctional polyhedral oligomeric silsesquioxanes. In certain embodiments, the present invention relates to any one of the aforementioned methods, wherein the complementarily-charged molecules are selected from the group consisting of multifunctional polyhedral oligomeric silsesquioxanes.

In certain embodiments, the complementarily-charged molecules are a polycation, such as poly(diallyl dimethyl ammonium chloride) (PDAC), polyallylaminehydrochloride (PAH) or linear polyethyleneimine (LPEI), or a positively charged dendrimer, such as poly(amidoamine) dendrimer (PAMAM).

In certain embodiments, the present invention relates to any one of the aforementioned methods, wherein the complementarily-charged molecules are selected from the group consisting of polyhedral oligomeric silsesquioxanes represented by formula I:

I

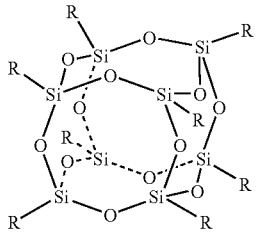

wherein R is —$(CH_2)_m$(alkylene)$(CH_2)_nNH_3^{+1}$, —$(CH_2)_m$(arylene)$(CH_2)_nNH_3^{+1}$, —$(CH_2)_m$(heteroarylene)$(CH_2)_nNH_3^{+1}$, —$(CH_2)_m$(alkylene)$(CH_2)_n$N(H)C(═O)C(H)═C(H)$COO^{-1}$, —$(CH_2)_m$(arylene)$(CH_2)_n$N(H)C(═O)C(H)═C(H)$COO^{-1}$, —$(CH_2)_m$(heteroarylene)$(CH_2)_n$N(H)C(═O)C(H)═C(H)$COO^{-1}$ or fluoroalkyl; m is 0-3 inclusive; and n is 0-3 inclusive.

In certain embodiments, the POSS is positively charged (and may be paired with a negatively charged metal oxide). For example, any of the protonated POSS-amines shown in FIGS. 10 and 11 may be used. In certain embodiments, the present invention relates to any one of the aforementioned methods, wherein R is —$(CH_2)_m$(alkylene)$(CH_2)_nNH_3^{+1}$. In certain embodiments, the present invention relates to any one of the aforementioned methods, wherein R is -(alkylene)$NH_3^{+1}$. In certain embodiments, the present invention relates to any one of the aforementioned methods, wherein R is —$CH_2CH_2NH_3^{+1}$, —$CH_2CH_2CH_2NH_3^{+1}$ or —$CH_2CH_2CH_2CH_2NH_3^{+1}$. In certain embodiments, the present invention relates to any one of the aforementioned methods, wherein R is —$CH_2CH_2CH_2NH_3^{+1}$ (i.e., octa(3-ammoniumpropyl)octasilsesquioxane).

In certain embodiments, the POSS is positively charged (and may be paired with a positively charged metal oxide). For example, any of the deprotonated POSS-carboxylic acids shown in FIG. 11 may be used. In certain embodiments, the present invention relates to any one of the aforementioned methods, wherein R is —$(CH_2)_m$(alkylene)$(CH_2)_n$NC(═O)C(H)═C(H)$COO^{-1}$. In certain embodiments, the present invention relates to any one of the aforementioned methods, wherein R is —(alkylene)N(H)C(═O)C(H)═C(H)$COO^{-1}$. In certain embodiments, the present invention relates to any one of the aforementioned methods, wherein R is —$CH_2CH_2$N(H)C(═O)C(H)═C(H)$COO^{-1}$, —$CH_2CH_2CH_2$N(H)C(═O)C(H)═C(H)$COO^{-1}$ or —$CH_2CH_2CH_2CH_2$N(H)C(═O)C(H)═C(H)$COO^{-1}$. In certain embodiments, the present invention relates to any one of the aforementioned methods, wherein R is —$CH_2CH_2CH_2$N(H)C(═O)C(H)═C(H)$COO^{-1}$.

In certain embodiments, the present invention relates to any one of the aforementioned methods, wherein the substrate is positively charged. In certain embodiments, the present invention relates to any one of the aforementioned methods, wherein the substrate is negatively charged. In certain embodiments, the present invention relates to any one of the aforementioned methods, further comprising the step of contacting the substrate with air plasma to generate a negatively-charged surface before contacting the substrate with a solution or aerosol of a first material.

In certain embodiments, the present invention relates to any one of the aforementioned methods, wherein the substrate is a fiber. In certain embodiments, the present invention relates to any one of the aforementioned methods, wherein the substrate is an electrospun polymer fiber (as described above). In certain embodiments, the present invention relates to any one of the aforementioned methods, wherein the substrate is an electrospun polymer fiber which is incorporated into a woven or non-woven fabric. In certain embodiment, the present invention relates to any one of the aforementioned methods, wherein the substrate is an electrospun polymer fiber comprising a silicon structure (e.g., a polysiloxane). In certain embodiments, the present invention relates to any one of the aforementioned methods, wherein the electrospun polymer fiber is electrospun from polystyrene (PS), polyacrylonitrile (PAN), a blend of poly(methyl methacrylate) (PMMA) and poly(ethylene oxide) (PEO), or poly(dimethylsiloxane-b-etherimide) (PSEI). In certain embodiments, the present invention relates to any one of the aforementioned methods, wherein the electrospun polymer fiber is electrospun from poly(dimethylsiloxane-b-etherimide) (PSEI).

In certain embodiments, the present invention relates to any one of the aforementioned methods, wherein the electrospun polymer fiber is rough. In certain embodiments, the present invention relates to any one of the aforementioned methods, wherein the electrospun polymer fiber is hierarchically rough. The reactive surface area of surface is one measure of its roughness. In certain embodiments, the present invention relates to any one of the aforementioned methods, wherein the surface is an electrospun polymer fiber with a reactive surface area of about 1 $m^2/g$ to about 1,000 $m^2/g$. In certain embodiments, the present invention relates to any one of the aforementioned methods, wherein the surface is an electrospun polymer fiber with a reactive surface area of about 100 $m^2/g$ to about 1,000 $m^2/g$. In certain embodiments, the present invention relates to any one of the aforementioned methods, wherein the surface is an electrospun polymer fiber with a reactive surface area of about 250 $m^2/g$ to about 1,000 $m^2/g$. In certain embodiments, the present invention relates to any one of the aforementioned methods, wherein the surface is an electrospun polymer fiber with a reactive surface area of about 500 $m^2/g$ to about 1,000 $m^2/g$. In certain embodiments, the present invention relates to any one of the aforementioned methods, wherein the surface is an electrospun polymer fiber with a reactive surface area of about 750 $m^2/g$ to about 1,000 $m^2/g$.

In certain embodiments, the present invention relates to any one of the aforementioned methods, wherein the diameter of the electrospun polymer fiber is from about 1 nm to about 10 nm. In certain embodiments, the present invention relates to any one of the aforementioned methods, wherein the diameter of the electrospun polymer fiber is from about 10 nm to about 50 nm. In certain embodiments, the present invention relates to any one of the aforementioned methods, wherein the diameter of the electrospun polymer fiber is from about 50 nm to about 100 nm. In certain embodiments, the present invention relates to any one of the aforementioned methods, wherein the diameter of the electrospun polymer fiber is from about 100 nm to about 300 nm. In certain embodiments, the present invention relates to any one of the aforementioned methods, wherein the diameter of the electrospun polymer fiber is from about 300 nm to about 500 nm. In certain embodiments, the present invention relates to any one of the aforementioned methods, wherein the diameter of the electrospun polymer fiber is from about 500 nm to about 700 nm. In certain embodiments, the present invention relates to any one of the aforementioned methods, wherein the diameter of the electrospun polymer fiber is from about 700 nm to about 1,000 nm. In certain embodiments, the present invention relates to any one of the aforementioned methods, wherein the diameter of the electrospun polymer fiber is from about 1,000 nm to about 1,300 nm. In certain embodiments, the present invention relates to any one of the aforementioned methods, wherein the diameter of the electrospun polymer fiber is from about 1,300 nm to about 1,600 nm.

In certain embodiments, the present invention relates to any one of the aforementioned methods, wherein the diameter of the electrospun polymer fiber is from about 400 nm to about 1300 nm. In certain embodiments, the present invention relates to any one of the aforementioned methods, wherein the average diameter of the electrospun polymer fiber is about 650 nm with a standard deviation of 180 nm.

In certain embodiments, the present invention relates to any one of the aforementioned methods, wherein the coating on the substrate has a coating thickness from about 5 nm to about 10 μm. In certain embodiments, the present invention relates to any one of the aforementioned methods, wherein the coating on the substrate has a coating thickness of about 5 nm. In certain embodiments, the present invention relates to any one of the aforementioned methods, wherein the coating on the substrate has a coating thickness of about 15 nm. In certain embodiments, the present invention relates to any one of the aforementioned methods, wherein the coating on the substrate has a coating thickness of about 30 nm. In certain embodiments, the present invention relates to any one of the aforementioned methods, wherein the coating on the substrate has a coating thickness of about 60 nm. In certain embodiments, the present invention relates to any one of the aforementioned methods, wherein the coating on the substrate has a coating thickness of about 120 nm.

In certain embodiments, the present invention relates to any one of the aforementioned methods, wherein the coating on the substrate has a coating thickness of from about 5 nm to about 500 nm. In certain embodiments, the present invention relates to any one of the aforementioned methods, wherein the coating on the substrate has a coating thickness of from about 500 nm to about 1,000 nm. In certain embodiments, the present invention relates to any one of the aforementioned methods, wherein the coating on the substrate has a coating thickness of from about 1,000 nm to about 1,500 nm.

Coated Articles

Another aspect of the invention relates to an article with a coated surface, comprising a surface and one or more bilayers on the surface; wherein at least one the one or more bilayers comprises a layer of positively-charged or negatively-charged metal oxide nanoparticles and a layer of complementarily charged molecules.

In certain embodiments, the present invention relates to any one of the aforementioned methods, wherein at least one of the bilayers comprises a layer of negatively-charged metal oxide nanoparticles and a layer of positively-charged molecules.

In certain embodiments, the present invention relates to any one of the aforementioned articles, wherein at least one of the bilayers comprises a layer of positively-charged metal oxide nanoparticles and a layer of negatively-charged molecules.

In certain embodiments, the present invention relates to any one of the aforementioned articles, wherein the article is a protective clothing system, woven fabric, a non-woven fabric, a filter, an adsorbant, a sensor, or an electrode.

In certain embodiments, the present invention relates to any one of the aforementioned articles, wherein the article comprises a first bilayer and a second bilayer; and the first bilayer is not the same as the second bilayer.

In certain embodiments, the present invention relates to any one of the aforementioned articles, wherein the metal oxide nanoparticles are alkali metal oxide nanoparticles. In certain embodiments, the present invention relates to any one of the aforementioned articles, wherein the metal oxide nanoparticles are alkaline earth metal oxide nanoparticles. In certain embodiments, the present invention relates to any one of the aforementioned articles, wherein the metal oxide nanoparticles are transition metal oxide nanoparticles. In certain embodiments, the present invention relates to any one of the aforementioned articles, wherein the metal oxide nanoparticles are lanthanide metal oxide nanoparticles. In certain embodiments, the present invention relates to any one of the aforementioned articles, wherein the metal oxide nanoparticles are group IIIA metal oxide nanoparticles. In certain embodiments, the present invention relates to any one of the aforementioned articles, wherein the metal oxide nanoparticles are group IVA metal oxide nanoparticles. In certain embodiments, the present invention relates to any one of the aforementioned articles, wherein the metal oxide nanoparticles are silica nanoparticles, titania nanoparticles, ceria nanoparticles, alumina nanoparticles, zirconia nanoparticles or combinations thereof. In certain embodiments, the present invention relates to any one of the aforementioned articles, wherein the metal oxide nanoparticles are titania nanoparticles. In certain embodiments, the present invention relates to any one of the aforementioned articles, wherein the metal oxide nanoparticles are anatase titania nanoparticles.

In certain embodiments, the present invention relates to any one of the aforementioned articles, wherein the diameter of the metal oxide nanoparticles is from about 1 nm to about 100 nm. In certain embodiments, the present invention relates to any one of the aforementioned articles, wherein the diameter of the metal oxide nanoparticles is from about 1 nm to about 25 nm. In certain embodiments, the present invention relates to any one of the aforementioned articles, wherein the diameter of the metal oxide nanoparticles is from about 5 nm to about 10 nm. In certain embodiments, the present invention relates to any one of the aforementioned articles, wherein the diameter of the metal oxide nanoparticles is about 7 nm.

In certain embodiments, the present invention relates to any one of the aforementioned articles, wherein the complementarily-charged molecules are selected from the group consisting of polyhedral oligomeric silsesquioxanes. In certain embodiments, the present invention relates to any one of the aforementioned articles, wherein the complementarily-charged molecules are selected from the group consisting of monofunctional polyhedral oligomeric silsesquioxanes. In certain embodiments, the present invention relates to any one of the aforementioned articles, wherein the complementarily-charged molecules are selected from the group consisting of multifunctional polyhedral oligomeric silsesquioxanes.

In certain embodiments, the complementarily-charged molecules are polycations, such as poly(diallyl dimethyl ammonium chloride) (PDAC), polyallylaminehydrochloride (PAH) or linear polyethyleneimine (LPEI), or a positively-charged dendrimers, such as poly(amidoamine) dendrimer (PAMAM).

In certain embodiments, the present invention relates to any one of the aforementioned articles, wherein the complementarily-charged molecules are selected from the group consisting of polyhedral oligomeric silsesquioxanes represented by formula I:

I

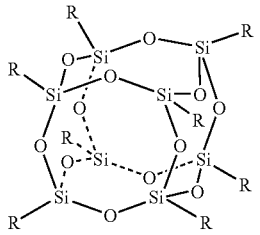

wherein R is —$(CH_2)_m$(alkylene)$(CH_2)_nNH_3^{+1}$, —$(CH_2)_m$(arylene)$(CH_2)_nNH_3^{+1}$, —$(CH_2)_m$(heteroarylene)$(CH_2)_nNH_3^{+1}$, —$(CH_2)_m$(alkylene)$(CH_2)_nN(H)C(=O)C(H)=C(H)COO^{-1}$, —$(CH_2)_m$(arylene)$(CH_2)_nN(H)C(=O)C(H)=C(H)COO^{-1}$, —$(CH_2)_m$(heteroarylene)$(CH_2)_nN(H)C(=O)C(H)=C(H)COO^{-1}$ or fluoroalkyl; m is 0-3 inclusive; and n is 0-3 inclusive.

In certain embodiments, the POSS is positively charged (and may be paired with a negatively charged metal oxide). For example, any of the POSS-amines shown in FIGS. 10 and 11, once protonated, may be used. In certain embodiments, the present invention relates to any one of the aforementioned articles, wherein R is —$(CH_2)_m$(alkylene)$(CH_2)_nNH_3^{+1}$. In certain embodiments, the present invention relates to any one of the aforementioned articles, wherein R is -(alkylene)$NH_3^{+1}$. In certain embodiments, the present invention relates to any one of the aforementioned articles, wherein R is —$CH_2CH_2NH_3^{+1}$, —$CH_2CH_2CH_2NH_3^{+1}$ or —$CH_2CH_2CH_2CH_2NH_3^{+1}$. In certain embodiments, the present invention relates to any one of the aforementioned articles, wherein R is —$CH_2CH_2CH_2NH_3^{+1}$ (i.e., octa(3-ammoniumpropyl)octasilsesquioxane).

In certain embodiments, the POSS is positively charged (and may be paired with a positively charged metal oxide). For example, any of the POSS-carboxylic acids shown in FIG. 11, once deprotonated, may be used. In certain embodiments, the present invention relates to any one of the aforementioned articles, wherein R is —$(CH_2)_m$(alkylene)$(CH_2)_nNC(=O)C(H)=C(H)COO^{-1}$. In certain embodiments, the present invention relates to any one of the aforementioned articles, wherein R is —(alkylene)$N(H)C(=O)C(H)=C(H)COO^{-1}$. In certain embodiments, the present invention relates to any one of the aforementioned articles, wherein R is —$CH_2CH_2N(H)C(=O)C(H)=C(H)COO^{-1}$, —$CH_2CH_2CH_2N(H)C(=O)C(H)=C(H)COO^{-1}$ or —$CH_2CH_2CH_2CH_2N(H)C(=O)C(H)=C(H)COO^{-1}$. In certain embodiments, the present invention relates to any one of the aforementioned articles, wherein R is —$CH_2CH_2CH_2N(H)C(=O)C(H)=C(H)COO^{-1}$.

In certain embodiments, the present invention relates to any one of the aforementioned articles, wherein the surface is positively charged. In certain embodiments, the present invention relates to any one of the aforementioned articles, wherein the surface is negatively charged. In certain embodiments, the present invention relates to any one of the aforementioned articles, further comprising the step of contacting the surface with air plasma to generate a negatively-charged surface before contacting the surface with a solution or aerosol of a first material.

In certain embodiments, the present invention relates to any one of the aforementioned articles, wherein the surface is a fiber. In certain embodiments, the present invention relates to any one of the aforementioned articles, wherein the surface is an electrospun polymer fiber (as described above). In certain embodiments, the article is a woven or non-woven fabric containing a plurality of electrospun fibers (i.e. the surface is an electrospun fiber). In certain embodiment, the present invention relates to any one of the aforementioned articles, wherein the surface is an electrospun polymer fiber comprising a silicon structure (e.g., a polysiloxane). In certain embodiments, the present invention relates to any one of the aforementioned articles, wherein the electrospun polymer fiber is electrospun from polystyrene (PS), polyacrylonitrile (PAN), a blend of poly(methyl methacrylate) (PMMA) and poly(ethylene oxide) (PEO), or poly(dimethylsiloxane-b-etherimide) (PSEI). In certain embodiments, the present invention relates to any one of the aforementioned articles, wherein the electrospun polymer fiber is electrospun from poly(dimethylsiloxane-b-etherimide) (PSEI).

In certain embodiments, the present invention relates to any one of the aforementioned articles, wherein the electrospun polymer fiber is rough. The reactive surface area of surface is one measure of the roughness of a surface. In certain embodiments, the present invention relates to any one of the aforementioned articles, wherein the electrospun polymer fiber is hierarchically rough. In certain embodiments, the present invention relates to any one of the aforementioned articles, wherein the surface is an electrospun polymer fiber with a reactive surface area of about 1 $m^2/g$ to about 1,000 $m^2/g$. In certain embodiments, the present invention relates to any one of the aforementioned articles, wherein the surface is an electrospun polymer fiber with a reactive surface area of about 100 $m^2/g$ to about 1,000 $m^2/g$. In certain embodiments, the present invention relates to any one of the aforementioned articles, wherein the surface is an electrospun polymer fiber with a reactive surface area of about 250 $m^2/g$ to about 1,000 $m^2/g$. In certain embodiments, the present invention relates to any one of the aforementioned articles, wherein the surface is an electrospun polymer fiber with a reactive surface area of about 500 $m^2/g$ to about 1,000 $m^2/g$. In certain embodiments, the present invention relates to any one of the aforementioned articles, wherein the surface is an electrospun polymer fiber with a reactive surface area of about 750 $m^2/g$ to about 1,000 $m^2/g$.

In certain embodiments, the present invention relates to any one of the aforementioned articles, wherein the diameter of the electrospun polymer fiber is from about 1 nm to about 10 nm. In certain embodiments, the present invention relates to any one of the aforementioned articles, wherein the diameter of the electrospun polymer fiber is from about 10 nm to about 50 nm. In certain embodiments, the present invention relates to any one of the aforementioned articles, wherein the diameter of the electrospun polymer fiber is from about 50 nm to about 100 nm. In certain embodiments, the present invention relates to any one of the aforementioned articles, wherein the diameter of the electrospun polymer fiber is from about 100 nm to about 300 nm. In certain embodiments, the present invention relates to any one of the aforementioned articles, wherein the diameter of the electrospun polymer fiber is from about 300 nm to about 500 nm. In certain embodiments, the present invention relates to any one of the aforementioned articles, wherein the diameter of the electrospun polymer fiber is from about 500 nm to about 700 nm. In certain embodiments, the present invention relates to any one of the aforementioned articles, wherein the diameter of the electrospun polymer fiber is from about 700 nm to about 1,000 nm. In certain embodiments, the present invention relates to any one of the aforementioned articles, wherein the diameter of the electrospun polymer fiber is from about 1,000 nm to about 1,300 nm. In certain embodiments, the present invention relates to any one of the aforementioned articles, wherein the diameter of the electrospun polymer fiber is from about 1,300 nm to about 1,600 nm.

In certain embodiments, the present invention relates to any one of the aforementioned articles, wherein the diameter of the electrospun polymer fiber is from about 400 nm to about 1300 nm. In certain embodiments, the present invention relates to any one of the aforementioned articles, wherein the average diameter of the electrospun polymer fiber is about 650 nm with a standard deviation of 180 nm.

In certain embodiments, the present invention relates to any one of the aforementioned articles, wherein the coated surface has a coating thickness from about 5 nm to about 10 μm. In certain embodiments, the present invention relates to any one of the aforementioned articles, wherein the coated surface has a coating thickness of about 5 nm. In certain embodiments, the present invention relates to any one of the aforementioned articles, wherein the coated surface has a coating thickness of about 15 nm. In certain embodiments, the present invention relates to any one of the aforementioned articles, wherein the coated surface has a coating thickness of about 30 nm. In certain embodiments, the present invention relates to any one of the aforementioned articles, wherein the coated surface has a coating thickness of about 60 nm. In certain embodiments, the present invention relates to any one of the aforementioned articles, wherein the coated surface has a coating thickness of about 120 nm.

In certain embodiments, the present invention relates to any one of the aforementioned articles, wherein the coated surface has a coating thickness of from about 5 nm to about 500 nm. In certain embodiments, the present invention relates to any one of the aforementioned articles, wherein the coated surface has a coating thickness of from about 500 nm and 1,000 nm. In certain embodiments, the present invention relates to any one of the aforementioned articles, wherein the coated surface has a coating thickness of from about 1,000 nm to 1,500 nm.

EXEMPLIFICATION

The invention now being generally described, it will be more readily understood by reference to the following, which is included merely for purposes of illustration of certain aspects and embodiments of the present invention, and is not intended to limit the invention.

Figure 1:
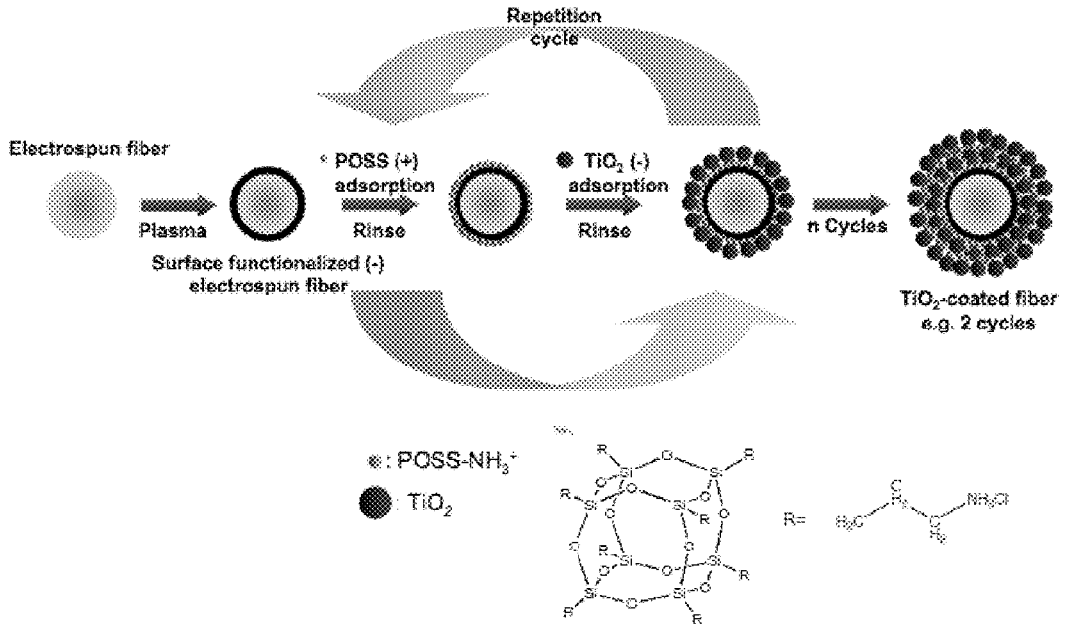
FIG. 1 depicts a schematic illustration of the preparation of $TiO_2$-coated electrospun polymer fibers using a layer-by-layer deposition method.
Figure 1:
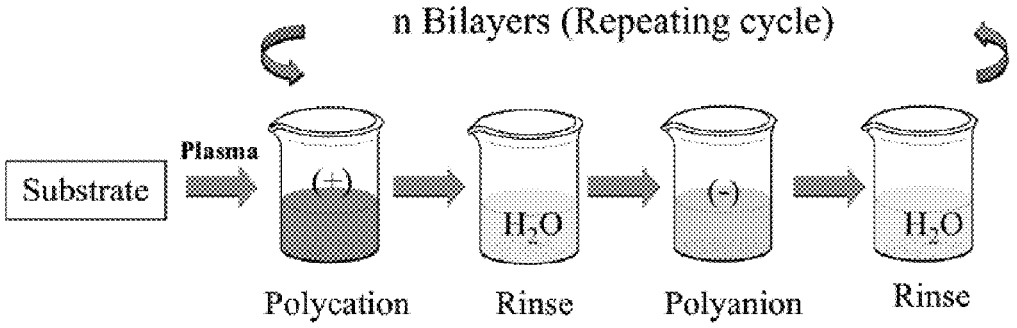

A method for preparing highly photoreactive $TiO_2$-coated fibers for various potential applications (such as a protective clothing system, woven fabric, a non-woven fabric, a filter, an adsorbant, photocatalysis, sensors, and electrodes) is described below. In general, negatively-charged colloidal $TiO_2$ nanoparticles were synthesized and adsorbed directly onto electrospun polymer fibers in the form of an ultrathin conformal coating using Layer-by-Layer (LbL) deposition with positively charged POSS molecules. It is demonstrated that by choosing appropriate cationic materials (such as POSS molecules), the polymer nanofibers can be protected against degradation by photocatalysis. An illustration of the process for preparing $TiO_2$-coated polymer nanofibers is shown in FIG. 1. In order to increase the efficiency of $TiO_2$ photocatalysis, fibers with a high surface area to volume ratio were electrospun from various polymer solutions and subsequently coated with $TiO_2$ nanoparticles using LbL assembly.

Electrospinning of Polymer Fibers

Electrospinning is a popular method to fabricate continuous ultrafine fibers with micrometer and sub-micrometer diameters from a variety of polymer solutions or melts. J. Doshi, D. H. Reneker, *J. Electrost.* 1995, 35, 151; Y. M. Shin, M. M. Hohman, M. P. Brenner, G. C. Rutledge, *Appl. Phys. Lett.* 2001, 78, 1149; D. Li, Y. N. Xia, *Adv. Mater.* 2004, 16, 1151; C. W. Kim, M. W. Frey, M. Marquez, Y. L. Joo, *J. Polym. Sci. Pt. B-Polym. Phys.* 2005, 43, 1673; and G. C. Rutledge, S. V. Fridrikh, *Adv. Drug. Deliv. Rev.* 2007, 59, 1384.

Nanofibers were electrospun from polystyrene (PS), polyacrylonitrile (PAN), a blend of poly(methyl methacrylate) (PMMA) and poly(ethylene oxide) (PEO), and poly(dimethylsiloxane-b-etherimide) (PSEI) and subsequently used as substrates for LbL assembly, to demonstrate that the $TiO_2$ coating process is simple and general. As representative of these several materials, the results for photocatalytic activity for PSEI are disclosed herein.

PSEI is a random block copolymer containing 35~40 wt % of siloxane unit in polyetherimide (PEI) units, which provides the fibers with good mechanical properties and UV and thermal resistance. The glass transition temperature ($T_g$) of PSEI ($T_g$=170° C.) is lower than that of PEI ($T_g$=210° C.). The siloxane units improves the flexibility and compatibility of the PEI with other siloxane materials such a cationic siloxane used in the LbL process.

Poly(dimethylsiloxane-b-etherimide) (PSEI) was purchased from Gelest and used as received. All other polymers and chemicals used in this study were purchased from Aldrich and used without purification. The PSEI nanofibers were electrospun from 22 wt % solution of PSEI in dimethylformamide (DMF) and pyridine (8:2 by volume) using a custom-built electrospinning apparatus. Y. M. Shin, M. M. Hohman, M. P. Brenner, G. C. Rutledge, *Polymer* 2001, 42, 9955. The voltage, solution flow rate, and plate-to-plate distance were set to 30 kV, 0.01 mL/min, and 35 cm, respectively. The electrospinning parameters for different polymers shown in FIG. 4 are listed in FIG. 7; SEM images of electrospun fibers of these polymers are also shown in FIG. 7.

SEM Images of Uncoated Fibers

Figure 2:
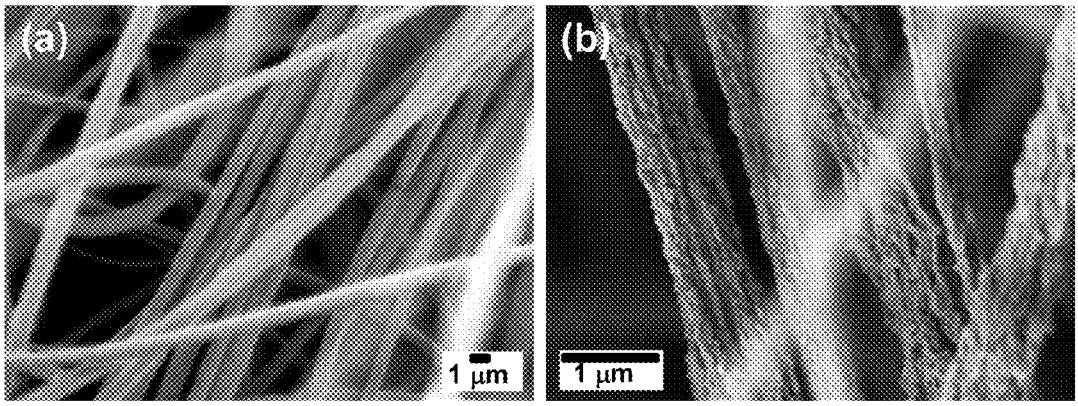
FIG. 2 depicts SEM images of electrospun PSEI nanofibers (a); and magnified image of electrospun PSEI fibers (b).

Scanning electron microscopy (SEM) images of electrospun PSEI fibers (formed from a solution of 22 wt % PSEI in N,N-dimethyl formamide (DMF)/pyridine as discussed above) collected as a nonwoven mat are shown in FIG. 2. As is typical for electrospun fibers, there is a distribution of fiber diameters and the fibers are randomly oriented. The diameter distribution of the PSEI fibers ranged from 400 to 1300 nm. The average diameter is 650 nm with a standard deviation of 180 nm. FIG. 2(*b*) shows surface roughness that has been created on the fibers during the electrospinning process.

Layer-by-Layer Coating of Fibers

The LbL assembly process involves the sequential adsorption of oppositely charged materials to construct ultrathin conformal coatings. G. Decher, *Science* 1997, 277, 1232; and P. T. Hammond, *Adv. Mater.* 2004, 16, 1271.

Instead of traditional linear cationic polyelectrolytes such as poly(allylamine hydrochloride) (PAH) and poly(dimethyldiallylammonium chloride) (PDAC), positively charged POSS molecules, in particular octa(3-ammoniumpropyl)octasilsesquioxane octachloride (POSS—$NH_3^+$, Hybrid Plastics), were newly introduced for the $TiO_2$ LbL nanoparticle coating. POSS-$NH_3^+$ was chosen as the cationic material due to its oxidation resistance and thermal stability. K. Naka, M.

Sato, Y. Chujo, *Langmuir* 2008, 24, 2719; and L. Zheng, R. J. Farris, E. B. Coughlin, *Macromolecules* 2001, 34, 8034. As detailed below, the PSEI electrospun mats coated with POSS-$NH_3^+$/$TiO_2$ show improved resistance against organic solvents and UV exposure compared to non-coated PSEI or cationic polymers/$TiO_2$-coated PSEI electrospun mats.

The negatively charged colloidal $TiO_2$ nanoparticles were synthesized by slowly combining a solution of 1 part tetrabutyl ammonium hydroxide and 50 parts absolute ethanol with a solution of 1 part titanium (IV) isopropoxide and 6 parts absolute ethanol by volume. The combined solution was then slowly diluted with Milli-Q water (18 MΩcm) to 4 times its original volume under rapid stirring and refluxed for 2 days at 95° C. The resulting $TiO_2$ colloidal solution (pH 10.0) was analyzed using ZetaPALS Zeta-potential analyzer (Brookhaven Instruments Corp.) for surface charge measurements and a powder X-ray diffractometer (Rigaku) for crystalline structure and particle size.

The mean diameter of the stabilized $TiO_2$ particles from dynamic light scattering was 7±1 nm. This value was confirmed by TEM. X-ray diffraction results confirmed the anatase phase of the $TiO_2$. The anatase phase provides better photocatalytic activity than other forms of $TiO_2$ such as rutile or brookite. M. A. Fox, M. T. Dulay, *Chem. Rev.* 1993, 93, 54. Zeta-potential analysis indicated that the particles have sufficient surface charge (−34 mV) for LbL deposition.

A 10 mM of POSS-$NH_3^+$ molecule (octa(3-ammoniumpropyl)octasilsesquioxane octachloride, Hybrid Plastics) dipping solution was prepared with the pH value of 7.5. Dipping solutions and rinsing water were pH-adjusted using 1.0 M NaOH or HCl prior to LbL assembly. LbL deposition for $TiO_2$ coating was conducted on electrospun fibers after plasma treatment for 1 min (Harrick PCD 32G). A Carl Zeiss DS50 programmable slide stainer was used for LbL deposition. An electrostatically bonded coating on fibers was prepared by alternative dipping in POSS-$NH_3^+$ and $TiO_2$ solutions. The dipping time in each solution was 30 min followed by three rinse steps (1, 1, and 1 min) in Milli-Q water.

The electrospun fibers of PSEI were treated with low-pressure air plasma for 1 min to introduce negatively charged surface groups before being coated with alternating layers of positively charged POSS and negatively charged $TiO_2$ nanoparticles. The surface functionalization of polymer materials using low-pressure plasma treatment is a well-known method to obtain acidic groups on the surface without affecting the bulk properties. C. C. Dupont-Gillain, Y. Adriaensen, S. Derclaye, P. G. Rouxhet, *Langmuir* 2000, 16, 8194; J. Kim, M. K. Chaudhury, M. J. Owen, *J. Colloid Interface Sci.* 2000, 226, 231; and L. J. Gerenser, *J. Adhes. Sci. Technol.* 1993, 7, 1019. These acidic groups, which form anions in water, help to improve adsorption of positively charged electrolyte materials in the initial step of the LbL process. SEM images (not shown herein) confirm that the air plasma treated electrospun fibers did not exhibit any distinguishable morphological changes. The formation of hydrophilic acidic groups was monitored simply by measurement of the water contact angle. The initial superhydrophobic electrospun PSEI mat ($\theta_A/\theta_R$=169°/158°, where $\theta_A$ and $\theta_R$ are the advancing and receding contact angles) became completely wettable after plasma treatment, due to the change in surface interaction with water. M. L. Ma, R. M. Hill, J. L. Lowery, S. V. Fridrikh, G. C. Rutledge, *Langmuir* 2005, 21, 5549; J. A. Lee, T. J. McCarthy, *Macromolecules* 2007, 40, 3965; and M. L. Ma, M. Gupta, Z. Li, L. Zhai, K. K. Gleason, R. E. Cohen, M. F. Rubner, G. C. Rutledge, *Adv. Mater.* 2007, 19, 255. Sequential LbL deposition using POSS-$NH_3^+$ and $TiO_2$ nanoparticles onto PSEI electrospun fibers was repeated 5 times with a 30 min immersion in each solution.

SEM Images of Coated PSEI Fibers

Figure 3:
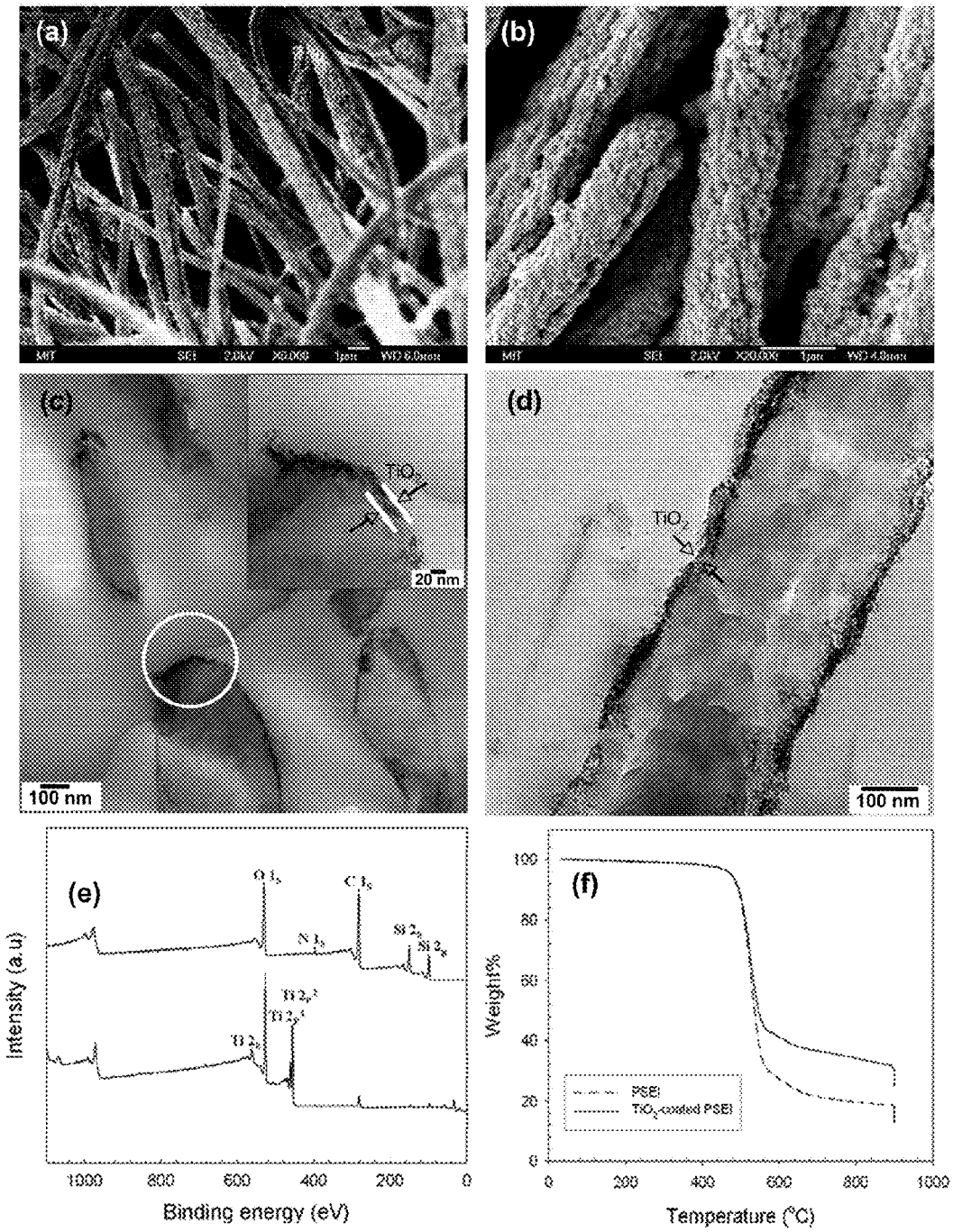
FIG. 3 depicts SEM images of $TiO_2$-coated PSEI fibers (a); and magnified image of $TiO_2$-coated PSEI fibers (b) (scale bars=1 μm). TEM images of $TiO_2$-coated PSEI fibers; axial view (c) (the inset shows the enlarged image of selected area with white circle); and longitudinal view (d). XPS spectra of as-spun PSEI nanofibers and $TiO_2$-coated PSEI nanofibers (e). TGA curves of as-spun and $TiO_2$-coated PSEI nanofibers (f).

Although it is difficult to identify an individual nanoparticle on the nanofibers, SEM images in FIGS. 3(*a*) and (*b*) show that the PSEI fibers were conformally coated. TEM images in FIGS. 3(*c*) and (*d*) illustrate that the coatings cover each fiber completely and confirm the presence of $TiO_2$ nanoparticles, seen in dark contrast to the polymer fibers. In addition, it appears that the coating layers are stable against rubbing and folding, to which the samples were subjected during TEM sample preparation. The layer thickness of particles on the fiber is approximately about 25 nm.

XPS of Coated PSEI Fibers

The coatings on the electrospun fibers were examined by X-ray photoelectron spectroscopy (XPS). FIG. 3(*e*) displays the survey spectra of the samples before and after coating. The survey spectrum after coating confirms that $TiO_2$ (560 eV and 455~465 eV for Ti2s and Ti2p) particles cover the surface of the nanofibers and that this $TiO_2$ coating essentially attenuates the carbon substrate signal (285 eV for C1s). The amount of material added with the coating was estimated by comparison of the TGA (thermo gravimetric analyzer) curves for the coated and uncoated samples after heating to 900° C. and holding isothermally at this temperature for 1 h under nitrogen (FIG. 3(*f*)). A weight loss of 10% was observed between the samples. It is possible to control the thickness of the coating by changing the number of cycles during the LbL process.

FIG. 3 demonstrates the feasibility of coaring $TiO_2$ nanoparticles with POSS on the surface of PS, PAN, and PMMA/PEO electrospun polymer fibers. The entire surface of the electrospun fibers was evenly decorated with anatase $TiO_2$ particles.

Photocatalytic Activity of Coated PSEI Fibers

To test the photocatalytic activity of the $TiO_2$ decorated electrospun fiber mats, permeation tests were conducted using a specially designed stainless steel permeation cell under UV illumination. A $TiO_2$ coated electrospun sample (area density=2 mg/cm$^2$) was mounted in series with a non-porous but semi-permeable poly(vinylidene chloride) film (Saran 8, 12.7 μm thickness, Dow Chemical) and subjected to a saturated vapor of a toxic chemical. The cell has a vapor space of known volume above the mounted sample and is sealed with a quartz cap to allow UV illumination. The non-porous Saran 8 polymer film was used in series with the LbL electrospun mat to control diffusion time and increase residence time for the catalytic reaction to occur, since the electrospun nanofiber sample is highly porous. A clean carrier gas was continually passed under the permeate side of the sample; it served to sweep contaminated gas from the cell for analysis in a Total Hydrocarbon Analyzer (THA) equipped with a Flame Ionization Detector (FID) capable of contaminant detection at levels as low as 0.01 ppm. By recording the mass flux of toxic chemicals in the sweep stream, their degradation in the vapor phase was monitored with time. The permeation cell has been described previously. K. C. Krogman, N. S. Zacharia, D. M. Grillo, P. T. Hammond, *Chem. Mater.* 2008, 20, 1924.

Figure 5:
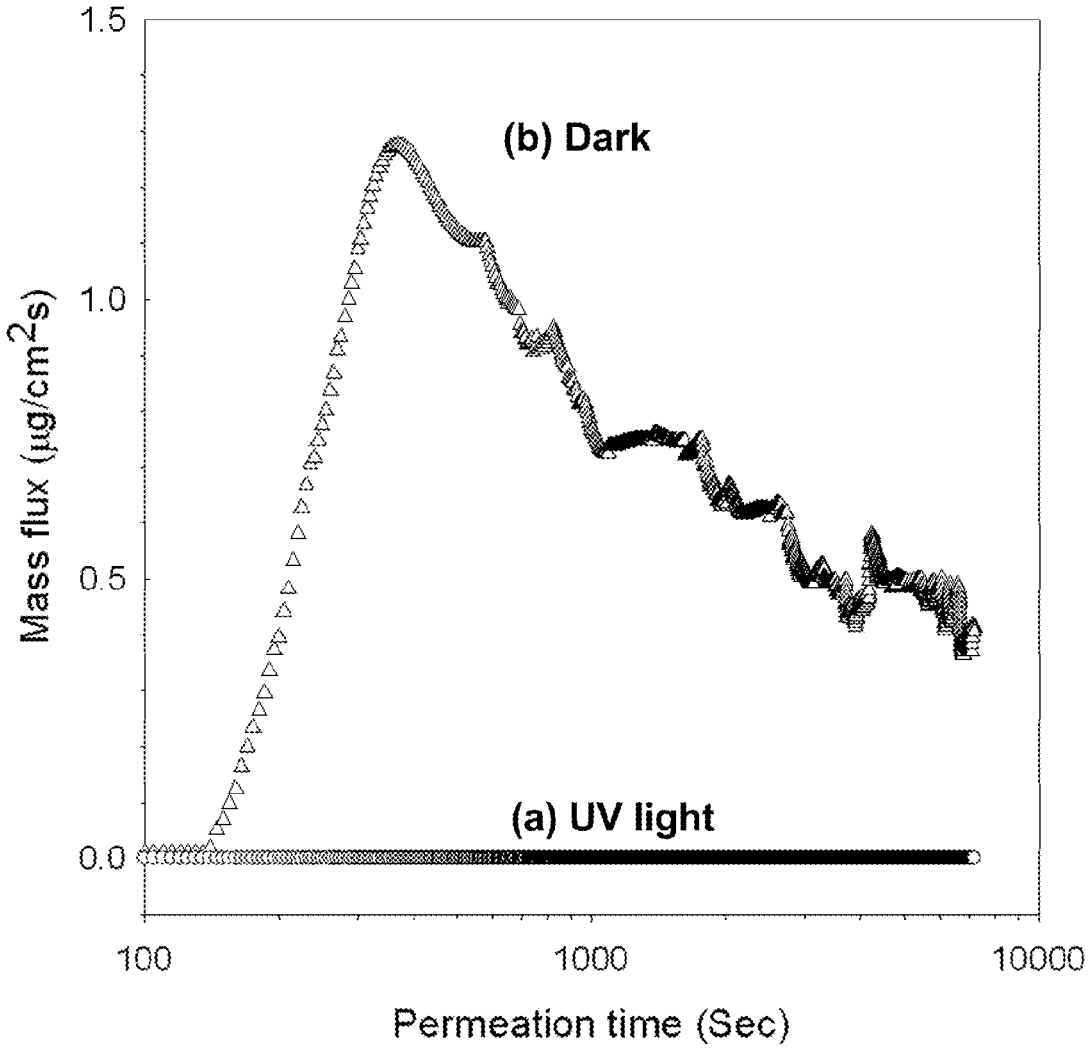
FIG. 5 depicts a graph showing mass flux of allyl alcohol permeating through a $TiO_2$-coated sample as measured in the carrier gas passing below the sample. Identically prepared samples were exposed to 3 μL loadings of allyl alcohol and allowed to permeate. The test was conducted both with (a)

Allyl alcohol (2-propen-1-ol), which is considered a high-risk toxic chemical (USACHPPM ITF-40 list), was chosen as a prototypical TIC contaminant for testing purposes. Allyl alcohol vapor (3 μL condensed liquid dose) in the vapor space of the cell diffused into the $TiO_2$ coated sample (diameter=10.32 mm), which was simultaneously illuminated with 100 mW/cm$^2$ UV light. Allyl alcohol was then detected in the sweep stream while the products of the photocatalysis degradation were carried away undetected. The mass fluxes of allyl alcohol versus permeation time with and without UV light (no photocatalytic activity) are compared in FIG. 5. The overall allyl alcohol permeation was significantly reduced when the sample is illuminated with UV light; contaminant levels never reached the detection limit of 0.01 ppm.

To confirm that the allyl alcohol was photocatalytically degraded and not simply adsorbed to the coated sample, FTIR analysis was conducted in a quartz gas cell (10 cm pathlength, 0.51 $in^2$ window). The condensed allyl alcohol (3 μL) was introduced into the front part of the quartz cell along the beam direction. There was no direct contact to the $TiO_2$-coated sample (1.5×1.5 $cm^2$ size) pre-installed in the quartz cell. It was allowed to vaporize for 10 min. The entire quartz cell was then illuminated by UV light. The allyl alcohol vapor passing through the coated sample was analyzed at 10 min intervals, beginning 5 min after the start of the UV illumination. As the UV illumination time increased, the intensity of the allyl alcohol peaks decreased and was remarkably attenuated within an hour, as shown in FIG. 6. For comparison, the non-UV illuminated test is also shown. In contrast to this decrease of all of the original characteristic allyl alcohol peaks, strong absorbance peaks around 1750 $cm^{-1}$ appeared and increased as the test proceeded. These bands clearly indicate the formation of carbonyl groups. These can be assigned to an aldehyde, which is the main reaction product during the decomposition of allyl alcohol by photocatalysis. A. De Visscher, J. Dewulf, J. Van Durme, C. Leys, R. Morent, H. Van Langenhove, *Plasma Sources Sci. Technol.* 2008, 17, 015004. The identical FTIR experiment was conducted using a $TiO_2$-coated sample on the flat film substrate (1.5×1.5 $cm^2$) for comparison and to demonstrate the effect of high surface area on photocatalysis (not shown here). This flat film was prepared by solvent casting from 22 wt % of PSEI solution in toluene. The test was conducted for 15 h. In this case, the original allyl alcohol peak intensity decreased by 50% during the test. The BET surface area for the PSEI electrospun fiber mat is 12 $m^2/g$ before $TiO_2$ coating. This is approximately $1.5\times10^4$ times higher than that of the flat PSEI film, calculated geometrically. This surface area difference between the electrospun fiber mat and a flat film might be increased after $TiO_2$ nanoparticles coating. It was also confirmed that there was no leakage of allyl alcohol during the FTIR test. No decomposition was detected using only UV illumination in the absence of the $TiO_2$-coated sample. No change in the FTIR spectra of allyl alcohol collected for 2 hr with UV illumination was observed.

Stability of Coated PSEI Fibers

The stability of the $TiO_2$-coated polymer fibers under UV illumination was investigated by comparing the samples before and after UV exposure for 10 h. FTIR spectra of these two samples are shown in FIG. 8. UV exposure of $TiO_2$-coated PSEI electrospun mat for 10 h did not generate any change in the FTIR spectrum of the as-coated sample. No macroscopic changes in shape or color were observed for the sample coated with POSS-$NH_3^+$/$TiO_2$ nanoparticle pair, while the $TiO_2$ samples coated with polycationic materials such as PDAC or PAH showed some yellowing after intense UV exposure for 10 h. No distinguishable morphology change was observed in SEM images. Although the degradation of the substrates was not quantified after UV exposure, one can mitigate concerns about the degradation of the substrate under severe photocatalysis conditions by increasing the number of inert coating layers using the $TiO_2$/POSS $NH_3^+$ electrolyte nanoparticle pair. A spray LbL deposition technique to improve coating speed and scale-up has previously been reported and may be used here. K. C. Krogman, N. S. Zacharia, S. Schroeder, P. T. Hammond, *Langmuir* 2007, 23, 3137.

Instrumentation

SEM images of electrospun fibers were obtained by a JEOL 6320FV field-emission high-resolution SEM instrument. A Kratos Axis Ultra XPS instrument (Kratos Analytical, Manchester) with a monochoromatized Al $K_\alpha$ X-ray source was used to analyze the surface chemistry of $TiO_2$ coated nanofibers. The take-off angle relative to the sample substrate was located at 90°. TEM samples of $TiO_2$ coated nanofibers were embedded in epoxy resin (LR White-Medium Grade, Ladd Research) and microtomed at room temperature into 50-100 nm thick sections. The samples were then examined using TEM (JEOL-200 CX). $TiO_2$ composition and thermal properties of nanofibers were determined using a TA Instruments TGAQ50 thermo gravimetric analyzer. BET surface areas of electrospun fibers were measured with an ASAP 2020 accelerated surface area and porosimetry analyzer (Micromeritics Instrument Co., Norcross).

Photocatalytic permeation tests were conducted in a stainless cell. Ultrapure compressed air was used as the sweep gas. The contaminated stream was detected and analyzed using a Series 23-550 Total Hydrocarbon Analyzer (Gow-MAC Instrument Co.) equipped with a flame ionization detector. The UV illumination was obtained from a Blue Wave 200 (Dymax) UV spot source (370~440 nm) filtered to ±100 $mV/cm^2$. FTIR was conducted using a Nexus 870 FTIR ESP (Thermo Nicolet) in a quartz gas cell with a 10 cm path length.

INCORPORATION BY REFERENCE

All of the U.S. patents and U.S. patent application publications cited herein are hereby incorporated by reference.

EQUIVALENTS

Those skilled in the art will recognize, or be able to ascertain using no more than routine experimentation, many equivalents to the specific embodiments of the invention described herein. Such equivalents are intended to be encompassed by the following claims.

We claim:

1. An article with a coated surface, comprising a surface and one or more bilayers on the surface;

wherein at least one of the one or more bilayers comprises a layer of positively-charged or negatively-charged metal oxide nanoparticles and a layer of complementarily-charged molecules, and the complementarily-charged molecules are selected from the group consisting of polyhedral oligomeric silsesquioxanes.

2. The article of claim 1, wherein at least one of the bilayers comprises a layer of negatively-charged metal oxide nanoparticles and a layer of positively-charged molecules.

3. The article of claim 1, wherein at least one of the bilayers comprises a layer of positively-charged metal oxide nanoparticles and a layer of negatively-charged molecules.

4. The article of claim 1, wherein the article is a protective clothing system, woven fabric, a non-woven fabric, a filter, an adsorbant, a sensor, or an electrode.

5. The article of claim 1, wherein the metal oxide nanoparticles are alkali metal oxide nanoparticles, alkaline earth metal oxide nanoparticles, transition metal oxide nanoparticles, lanthanide metal oxide nanoparticles, group IIIA metal oxide or group IVA metal oxide nanoparticles.

6. The article of claim 1, wherein the metal oxide nanoparticles are silica nanoparticles, titania nanoparticles, ceria nanoparticles, alumina nanoparticles, zirconia nanoparticles, or any combination thereof.

7. The article of claim 1, wherein the metal oxide nanoparticles are titania nanoparticles.

8. The article of claim 1, wherein the metal oxide nanoparticles are anatase titania nanoparticles.

9. The article of claim 1, wherein the diameter of the metal oxide nanoparticles is from about 1 nm to about 100 nm.

10. The article of claim 1, wherein the polyhedral oligomeric silsesquioxanes are represented by formula I:

I

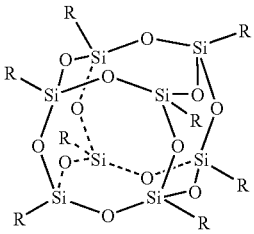

wherein R is —$(CH_2)_m$(alkylene)$(CH_2)_n NH_3^{+1}$, —$(CH_2)_m$(arylene)$(CH_2)_n NH^{-1}$, —$(CH_2)_m$(heteroarylene)$(CH_2)_n NH_3^{-1}$, —$(CH_2)_m$(alkylene)$(CH_2)_n$N(H)C(=O)C(H)=C(H)$COO^{-1}$, —$(CH_2)_m$(arylene)$(CH_2)_n$N(H)C(=O)C(H)=C(H)$COO^{-1}$, —$(CH_2)_m$(heteroarylene)$(CH_2)_n$N(H)C(=O)C(H)=C(H)$COO^{-1}$ or fluoroalkyl; m is 0-3 inclusive; and n is 0-3 inclusive.

11. The article of claim 10, wherein R is —$(CH_2)_m$(alkylene)$(CH_2)_n NH_3^{-1}$.

12. The article of claim 10, wherein R is -(alkylene)$NH_3^{-1}$.

13. The article of claim 10, wherein R is —$CH_2CH_2NH_3^{-1}$, —$CH_2CH_2CH_2NH_3^{-1}$ or —$CH_2CH_2CH_2CH_2NH_3^{+1}$.

14. The article of claim 10, wherein R is —$CH_2CH_2CH_2NH_3^{-1}$.

15. The article of claim 1, wherein the surface is a fiber.

16. The article of claim 1, wherein the surface is an electrospun polymer fiber.

17. The article of claim 16, wherein the electrospun polymer fiber comprises a polysiloxane.

18. The article of claim 16, wherein the electrospun polymer fiber is electrospun from polystyrene (PS), polyacrylonitrile (PAN), a blend of poly(methyl methacrylate) (PMMA) and poly(ethylene oxide) (PEO), or poly(dimethylsiloxane-b-etherimide) (PSEI).

19. The article of claim 16, wherein the electrospun polymer fiber is electrospun from poly(dimethylsiloxane-b-etherimide) (PSEI).

* * * * *